US012048985B1

(12) United States Patent
Mukhopadhyay et al.

(10) Patent No.: US 12,048,985 B1
(45) Date of Patent: Jul. 30, 2024

(54) ASSEMBLIES AND METHODS OF FORMING POLYCRYSTALLINE DIAMOND USING SUCH ASSEMBLIES

(71) Applicant: US SYNTHETIC CORPORATION, Orem, UT (US)

(72) Inventors: Debkumar Mukhopadhyay, Sandy, UT (US); Paul Douglas Jones, Elk Ridge, UT (US); Daren Nathaniel Heaton, Spanish Fork, UT (US); Kevin Alexander Shirley, Sandy, UT (US)

(73) Assignee: US SYNTHETIC CORPORATION, Orem, UT (US)

( * ) Notice: Subject to any disclaimer, the term of this patent is extended or adjusted under 35 U.S.C. 154(b) by 268 days.

(21) Appl. No.: 17/363,410

(22) Filed: Jun. 30, 2021

Related U.S. Application Data

(60) Provisional application No. 63/048,523, filed on Jul. 6, 2020.

(51) Int. Cl.
*B24D 3/06* (2006.01)
*B24D 18/00* (2006.01)

(52) U.S. Cl.
CPC ..... *B24D 3/06* (2013.01); *B24D 18/0009* (2013.01)

(58) Field of Classification Search
CPC ..... B24D 3/06; B24D 18/0009
See application file for complete search history.

(56) References Cited

U.S. PATENT DOCUMENTS 4,627,503 A * 12/1986 Horton ..... C22C 26/00 175/420.2
4,636,253 A * 1/1987 Nakai ..... B01J 3/062 75/242
6,338,754 B1 1/2002 Cannon et al.
7,866,418 B2 1/2011 Bertagnolli et al.
7,985,059 B2 * 7/2011 Hall ..... B22F 3/1258 425/405.2
8,236,074 B1 8/2012 Bertagnolli et al.
8,313,677 B2 * 11/2012 Hall ..... B01J 3/06 264/109
8,863,864 B1 10/2014 Miess
(Continued)

FOREIGN PATENT DOCUMENTS

CN 108823483 A * 11/2018

OTHER PUBLICATIONS

U.S. Appl. No. 63/048,523, filed Jul. 6, 2020.
(Continued)

*Primary Examiner* — James A Fiorito
*Assistant Examiner* — Ross J Christie
(74) *Attorney, Agent, or Firm* — BKRIP LLC

(57) ABSTRACT

Embodiments disclosed herein are directed to assemblies for forming polycrystalline diamond compacts and methods for forming the polycrystalline diamond compacts with the assemblies. An example assembly includes a substrate and a diamond material positioned adjacent to an interfacial surface of the substrate. The assembly also includes an enclosure defining a chamber. The substrate and the diamond material are disposed in the chamber. In an embodiment, the assembly includes a sealant and the sealant includes at least one of cobalt or a copper-nickel alloy. In an embodiment, the substrate includes a concave bottom surface that is opposite the interfacial surface.

25 Claims, 11 Drawing Sheets

(56) References Cited

U.S. PATENT DOCUMENTS

| | | | |
|---|---|---|---|
| 9,346,149 | B1 | 5/2016 | Linford et al. |
| 9,487,847 | B2 | 11/2016 | Mukhopadhyay et al. |
| 9,765,572 | B2 | 9/2017 | Knuteson et al. |
| 9,828,810 | B2 * | 11/2017 | Drews ..... E21B 10/55 |
| 9,945,186 | B2 | 4/2018 | Mukhopadhyay et al. |
| 10,047,568 | B2 | 8/2018 | Mukhopadhyay et al. |
| 10,501,998 | B1 | 12/2019 | Linford et al. |

OTHER PUBLICATIONS

Decker, et al., "High-Pressure Calibration: A Critical Review", J. Phys. Chem. Ref. Data, vol. 1, No. 3, 1972, pp. 1, 3.

Rousse, et al., "Structure of the intermediate phase of PbTe at high pressue", Physical Review B, Condensed Matter and Materials Physics, 71, 2005, 224116-1-224116-6.

* cited by examiner

ASSEMBLIES AND METHODS OF FORMING POLYCRYSTALLINE DIAMOND USING SUCH ASSEMBLIES

CROSS-REFERENCE TO RELATED APPLICATIONS

This application claims priority to U.S. Provisional Application No. 63/048,523 filed on 6 Jul. 2020, the disclosure which is incorporated herein, in its entirety, by this reference.

BACKGROUND

Wear-resistant, superabrasive compacts are utilized in a variety of mechanical applications. For example, polycrystalline diamond compacts ("PDCs") are used in drilling tools (e.g., cutting elements, gage trimmers, etc.), machining equipment, bearing apparatuses, wire-drawing machinery, and in other mechanical apparatuses.

PDCs have found particular utility as superabrasive cutting elements in rotary drill bits, such as roller cone drill bits and fixed cutter drill bits. A PDC cutting element typically includes a superabrasive diamond layer commonly referred to as a polycrystalline diamond ("PCD") table. The PCD table is formed and bonded to a substrate using a high-pressure/high-temperature ("HPHT") process. The PDC cutting element may also be brazed directly into a preformed pocket, socket, or other receptacle formed in the bit body. The substrate may often be brazed or otherwise joined to an attachment member, such as a cylindrical backing. A rotary drill bit typically includes a number of PDC cutting elements affixed to the bit body. It is also known that a stud carrying the PDC may be used as a PDC cutting element when mounted to a bit body of a rotary drill bit by press-fitting, brazing, or otherwise securing the stud into a receptacle formed in the bit body.

Conventional PDCs are normally fabricated by placing a cemented carbide substrate into a container with a volume of diamond particles positioned adjacent to the cemented carbide substrate. A number of such cartridges may be loaded into an HPHT press. The substrates and volume of diamond particles are then processed under HPHT conditions in the presence of a catalyst material that causes the diamond particles to bond to one another to form a matrix of bonded diamond grains defining a PCD table that is bonded to the substrate. The catalyst material is often a metal-solvent catalyst (e.g., cobalt, nickel, iron, or alloys thereof) that is used for promoting intergrowth of the diamond particles.

In one conventional approach, a constituent of the cemented carbide substrate, such as cobalt from a cobalt-cemented tungsten carbide substrate, liquefies and sweeps from a region adjacent to the volume of diamond particles into interstitial regions between the diamond particles during the HPHT process. The cobalt acts as a catalyst to promote intergrowth between the diamond particles, which results in formation of bonded diamond grains. Often, a solvent catalyst may be mixed with the diamond particles prior to subjecting the diamond particles and substrate to the HPHT process.

Manufacturers and users of superabrasive elements, such as PDCs, continue to seek improved processing techniques.

SUMMARY

Embodiments disclosed herein are directed to assemblies for forming polycrystalline diamond compacts and methods for forming the polycrystalline diamond compacts with the assemblies. In an embodiment, an assembly is disclosed. The assembly includes a substrate including an interfacial surface, a bottom surface opposite the interfacial surface, and at least one lateral surface extending at least partially between the interfacial surface and the bottom surface. The assembly also includes a diamond material positioned at least proximate to the interfacial surface of the substrate. The assembly further includes an enclosure including an enclosure body. The enclosure body defines a chamber and an opening. The substrate and the diamond material are disposed in the chamber. Additionally, the assembly includes a sealant positioned at least proximate to the opening of the enclosure body. The sealant is configured to form or forms a binary alloying including a group of 8 element and a group 11 element.

In an embodiment, an assembly is disclosed. The assembly includes a substrate including an interfacial surface, a concave bottom surface opposite the interfacial surface, and at least one lateral surface extending at least partially between the interfacial surface and the bottom surface. The assembly also includes a diamond material positioned adjacent to the interfacial surface of the substrate. The diamond material includes diamond particles.

In an embodiment, a method is disclosed. The method includes disposing a substrate and a diamond material in a chamber defined by an enclosure. The substrate includes an interfacial surface, a bottom surface opposite the interfacial surface, and at least one lateral surface extending at least partially between the interfacial surface and the bottom surface, the diamond material positioned at least proximate to the interfacial. The enclosure defines an opening. The method also includes disposing a sealant adjacent to the opening. The sealant is configured to form or forms a binary alloying including a group of 8 element and a group 11 element. The substrate, the diamond material, the enclosure, and the sealant at least partially form an assembly. The method further includes applying an inert environment to at least the chamber, heating the assembly to a degassing temperature effective to at least partially remove absorbed gases from the diamond material, and melting the sealant such that the sealant seals the chamber from an exterior.

In an embodiment, a method is disclosed. The method includes disposing a substrate and a diamond material in a chamber defined by an enclosure. The substrate includes an interfacial surface, a concave bottom surface opposite the interfacial surface, and at least one lateral surface extending at least partially between the interfacial surface and the bottom surface, the diamond material positioned at least proximate to the interfacial. The enclosure defines an opening.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments of the present disclosure, wherein identical reference numerals refer to identical or similar elements or features in different views or embodiments shown in the drawings.

DETAILED DESCRIPTION

Figure 1A:
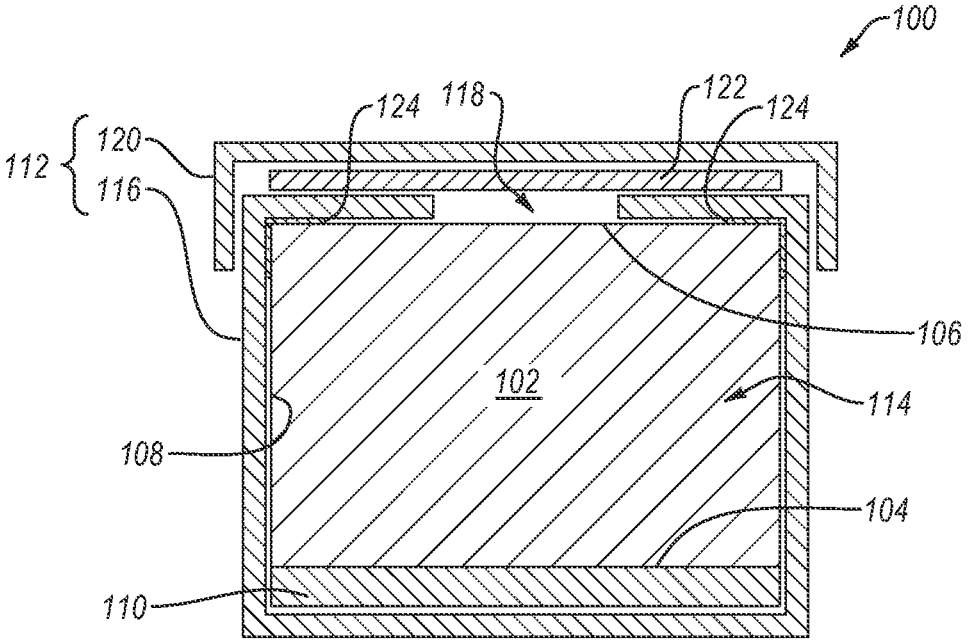
FIG. 1A is a cross-sectional view of an assembly before the assembly is sealed, according to an embodiment.

Embodiments disclosed herein are directed to assemblies for forming polycrystalline diamond compacts and methods for forming the polycrystalline diamond compacts with the assemblies. An example assembly includes a substrate and a diamond material positioned proximate or adjacent to an interfacial surface of the substrate. The assembly also includes an enclosure defining a chamber. The substrate and the diamond material are disposed in the chamber. The assembly is subjected to a high-pressure/high-temperature ("HPHT") process to form a polycrystalline diamond compact ("PDC"). The PDC includes a polycrystalline diamond ("PCD") table formed from the diamond material. The PCD table is bonded to the substrate.

In an embodiment, the assembly further includes a sealant disposed in the chamber. A sealant may include a binary alloy. In an embodiment, the sealant may comprise a binary alloy of a Group 8 element or an iron group element (e.g., iron, cobalt, nickel, alloys thereof, etc.) and a Group 11 element (e.g., copper, silver, gold, etc.). For example, a sealant may comprise a copper-nickel alloy. Such sealants may allow for the diamond material to be cleaned and effectively seal the chamber from an environment outside of the chamber, each of which may facilitate forming the PDC. For example, after forming the assembly, the chamber of the enclosure may be subjected to an inert environment (e.g., a vacuum) while the assembly is heated. Heating may at least partially degas the diamond material (e.g., remove at least a portion of absorbed gases from the diamond material). After the diamond material is at least partially degassed, the sealant melts and then may solidify (e.g., upon cooling) to hermetically seal the chamber. Sealing the chamber maintains the inert environment in the chamber to reduce or prevent oxidation of the diamond material during the HPHT process.

Conventionally, the sealant includes a braze material. Conventional braze materials may typically seal the chamber when the assembly is heated to a temperature that is greater than the melting temperature of the braze material. As used herein, the phrase "melting temperature" may refer to the liquidus temperature (i.e., the temperature above which all of the material is melted and below which the material is a mixture of liquid and solid), the solidus temperature (i.e., the temperature below which all of the material is solid and above which the material is a mixture of liquid and solid), or a eutectic temperature (i.e., a temperature at which the material turns directly from a solid to a liquid). Conventional braze material may include elements and compounds that may contaminate the PDC. For example, the conventional braze material may include silicon and boron, either of which may react with the diamond material to form non-diamond material should the braze material reach the diamond material. Further, the conventional braze material may exhibit a melting temperature that is less than a temperature at which the diamond material degasses ("degassing temperature"), may inhibit the degassing process, a melting temperature that is significantly greater than a temperature at which the diamond material degasses, which requires a significant amount of energy to melt, or a melting temperature that may cause contamination, degradation, or graphitization of the diamond material.

The binary alloys disclosed herein are improvements over conventional braze material. For example, alloys comprising cobalt or nickel may promote diamond-to-diamond bonding in the diamond material. Group 11 metals, such as copper, gold, or silver do not easily react with diamond. Further, the sealants disclosed herein may not impede the degassing of the diamond material or exhibit a melting temperature that results in significant graphitization of the diamond material. In an example, if the sealant where only cobalt, the cobalt would exhibit a melting temperature of 1495° C. As such, the cobalt does not melt when the assembly is heated to, for example, between 1200° C. and 1400° C. (e.g., about 1230° C., about 1240° C., or about 1250° C.). However, when the enclosure includes niobium and/or tantalum (the "enclosure material"), the enclosure material may diffuse and/or alloy with into the cobalt causing the melting temperature of the sealant to decrease. For instance, when the cobalt and the enclosure material form a eutectic composition, the melting temperature of the sealant may be selected to be below, at, or slightly above the degassing temperature at which the diamond powder substantially degasses. The assembly need not be heated above the degassing temperature or only to be heated to a second temperature slightly greater than the degassing temperature to melt the sealant. In an example, a copper-nickel alloy may exhibit a liquidus temperature and solidus temperature. The exact liquidus and solidus temperatures of the copper-nickel alloy depends on the weight percent copper in the copper-nickel alloy. However, generally, the liquidus temperature may be greater than the degassing temperature which may allow at least a portion of the copper-nickel alloy to be solid during the degassing process and may prevent the sealant from impeding the degassing process. After the degassing process, the assembly may be heated to a second temperature above the liquidus temperature of the copper-nickel alloy which may cause all of the copper-nickel alloy to melt. However, generally, the second temperature may be only slightly greater than the degassing temperature, which may decrease the energy required to melt the copper-nickel alloy.

Instead of or besides forming the assembly with a cobalt and/or copper-nickel alloy sealant, the bottom surface of the substrate (e.g., the surface of the substrate opposite the interfacial surface of the substrate that is proximate or adjacent to the diamond material) may be concave. For example, conventional substrates include a planar bottom surface. However, during the HPHT process, the difference in the coefficient of thermal expansion between the PCD table and the substrate causes the PCD table and the substrate to warp when the PDC is cooled to room temperature. The warping may cause the top surface of the PCD table (e.g., the surface of the PDC opposite the bottom surface of the substrate) to be concave and the bottom surface of the conventional substrate to be convex. The convex surface of the conventional substrate forms a poor datum during post-HPHT shaping processes (e.g., grinding, lapping, lasing, etc.). For instance, during the post-HPHT shaping processes, the convex surface of the conventional substrate may be disposed on a support surface. However, due to the convex shape of the bottom surface, the PDC may wobble or tilt on the support surface complicating the post-HPHT shaping processes. Further, planarizing the convex bottom surface of the conventional substrate requires additional processing.

Forming the bottom surface of the substrate to exhibit a generally concave shape prior to disposing the substrate in the assembly, may cause the bottom surface of the substrate to exhibit a relatively planar shape (e.g., a relatively less concave shape than the initial concave shape of a concave shape having a larger radius of curvature than the initial concave shape) after the HPHT process. The planar or concave shape of the bottom surface of the substrate may provide a better datum during post-HPHT shaping processes since the planar or concave shape of the bottom surface may not wobble or tilt on the support surface or may wobble or tilt less than it would with a conventional substrate.

FIG. 1A is a cross-sectional view of an assembly 100 before the assembly 100 is sealed, according to an embodiment. The assembly 100 includes a substrate 102. The substrate 102 includes an interfacial surface 104, a bottom surface 106 opposite the interfacial surface 104, and at least one lateral surface 108 extend between the interfacial surface 104 and the bottom surface 106. The assembly 100 also include diamond material 110 (e.g., a mass of diamond particles or a preformed PCD table) disposed proximate or adjacent to the interfacial surface 104 of the substrate 102. Additionally, the assembly 100 includes an enclosure 112 partially defining a chamber 114. In the illustrated embodiment, the enclosure 112 includes an enclosure body 116 defining an opening 118 and an enclosure cap 120 covering the opening 118. The chamber 114 is the space at least partially defined by the innermost surfaces of the enclosure 112 (e.g., the assembly of the enclosure body 116 and the enclosure cap 120). Further, the assembly 100 includes a sealant 122 that is positioned in the chamber 114.

The substrate 102 may be formed from any number of materials. Materials suitable for the substrate 102 may include, without limitation, cemented carbides, such as tungsten carbide, titanium carbide, chromium carbide, niobium carbide, tantalum carbide, vanadium carbide, or combinations thereof cemented with iron, nickel, cobalt, alloys thereof or combinations thereof. For example, the substrate 102 may include cobalt-cemented tungsten carbide. However, in certain embodiments, the substrate 102 may be omitted.

In an embodiment, as illustrated, the interfacial surface 104 and the bottom surface 106 of the substrate 102 are planar. However, in an embodiment, at least one of the interfacial surface 104 or the bottom surface 106 of the substrate 102 are non-planar. In an example, the interfacial surface 104 may be non-planar. In an example, the bottom surface 106 may be concave to counteract the warping of the substrate 102, as discussed in more detail below. More specifically, the substrate 102 may include one or more of the features described herein with respect to the substrate 302 and/or 402, without limitation In an embodiment, the diamond material 110 may include a mass of diamond particles. The mass of diamond particles may exhibit an average particle size of about 50 μm or less, such as about 40 μm or less, about 30 μm, or less, about 20 μm or less, about 10 μm to about 30 μm, about 10 μm to about 20 μm, or about 15 μm to about 18 μm. In some embodiments, the average particle size of the mass of diamond particles may be about 10 μm or less, such as about 2 μm to about 5 μm or submicron.

In some embodiments, the mass of diamond particles may include a relatively larger size and at least one relatively smaller size. As used herein, the phrases "relatively larger" and "relatively smaller" refer to particles sizes (by any suitable method) that differ by at least a factor of two (e.g., 30 μm and 15 μm). According to various embodiments, the mass of diamond particles may include a portion exhibiting a relatively larger size (e.g., 40 μm, 35 μm, 30 μm, 25 μm, 20 μm, 15 μm, 12 μm, 10 μm, 8 μm, 5 μm) and another portion exhibiting at least one relatively smaller size (e.g., 6 μm, 5 μm, 4 μm, 3 μm, 2 μm, 0.75 μm, 1 μm, 0.5 μm, 0.25 μm, less than 0.5 μm, 0.1 μm, less than 0.1 μm). In one embodiment, the diamond particles may include a portion exhibiting a relatively larger size between about 10 μm and about 40 μm and another portion exhibiting a relatively smaller size between about 1 μm and 4 μm. In some embodiments, the diamond particles may comprise three or more different sizes (e.g., one relatively larger size and two or more relatively smaller sizes), without limitation. In other embodiments, the diamond particles may exhibit a single mode or bimodal size distribution (e.g., a single mode or any of the foregoing sizes).

It is noted that the as-sintered diamond grain size may differ from the average particle size of the mass of diamond particles prior to sintering due to a variety of physical processes, such as grain growth, diamond particles fracturing, carbon provided from another carbon source (e.g., dissolved carbon in the metal-solvent catalyst), or combinations of the foregoing.

More details about diamond particle sizes and diamond particle size distributions that may be employed are disclosed in U.S. Pat. Nos. 9,346,149 and 10,501,998. Each of U.S. Pat. Nos. 9,346,149 and 10,501,998 is incorporated herein, in its entirety, by this reference.

In an embodiment, the diamond material 110 includes a preformed PCD table. The preformed PCD table may be formed by disposing an initial mass of diamond particles (e.g., any of the mass of diamond particles disclosed herein) adjacent to an initial substrate. The initial mass of diamond particles and the initial substrate may be disposed in an initial assembly. The initial assembly may be heated to clean the mass of diamond particles, sealed, and then subjected to a first HPHT process (e.g., a temperature greater than 1000° C. and a pressure greater than about 5 GPa or greater than about 7.5 GPa) to sinter the mass of diamond particles into the preformed PCD table. For example, a catalyst (e.g., from the substrate and/or a thin film disposed adjacent to the mass of diamond particles) may sweep into the initial mass of diamond particles to cause diamond-to-diamond bonding and the catalyst may at least partially occupy the interstitial regions between the diamond grains. Examples of sintering the initial mass of diamond particles into a preformed PCD table are disclosed in U.S. Pat. No. 7,866,418 filed on Oct. 3, 2008, the disclosure of which is incorporated herein, in its entirety, by this reference. The preformed PCD table may then be detached from the initial substrate using any suitable method (e.g., the initial substrate is grinded away). The preformed PCD table may then be disposed in the assembly 100 as disclosed herein (e.g., replacing the diamond powder). In some embodiments, the preformed PCD table may be leached to remove at least a portion of the catalyst (e.g., metal-solvent catalyst) from the interstitial regions of at least a portion of the PCD table.

The enclosure 112 (e.g., the body 116 and/or the cap 120) may be formed from at least one of steel, niobium, tantalum, alloys thereof, graphite structure, pyrophyllite, or any other suitable materials. For example, the enclosure 112 may exhibit good wetting with cobalt alloys and the copper-nickel alloys disclosed herein when the enclosure 112, especially the portions of the enclosure 112 that contacts the sealant 122, is formed from steel, niobium, tantalum, or alloys thereof which allows the sealant 122 to form a hermetic seal. Further, when the sealant 122 comprises cobalt, portions of the enclosure 112 may diffuse into the cobalt to form a eutectic composition when the enclosure 112 includes niobium or tantalum.

Further examples of enclosures are disclosed in U.S. Pat. Nos. 6,338,754 and 8,236,074, the disclosure of each of which is incorporated herein, in its entirety, by this reference. Any feature or features of such disclosed enclosures may be employed in combination with any feature or features of the embodiments disclosed herein.

The sealant 122 is disposed in the chamber 114 in such a manner that, when melted and subsequently cooled, the sealant 122 forms a hermetic seal. In an embodiment, as shown, the sealant 122 is a thin foil (e.g., exhibits a thickness that is less than 1 mm) Forming the sealant 122 as a thin foil may minimize the amount of material that is required to form the sealant 122. Also, as will be discussed in more detail below, forming the sealant 122 as a thin foil may facilitate diffusion of the enclosure material into the sealant 122. However, it is noted that the sealant 122 may exhibit other shapes and/or configurations. For example, the sealant 122 may include a mass of particles or a thick sealant material (e.g., the sealant 122 exhibits a thickness greater than 1 mm).

The sealant 122 is disposed in the chamber 114 in such a manner that, when melted, the sealant 122 forms a hermetic seal. In an embodiment, as illustrated, the sealant 122 may be disposed between the portion of the enclosure body 116 that defines the opening 118 and the enclosure cap 120. In such an embodiment, the sealant 122 may form a hermetic seal between at least the enclosure body 116 and the enclosure cap 120. In an embodiment, the sealant 122 may be at least partially disposed between the portion of the enclosure body 116 that defines the opening 118 and the bottom surface 106 of the substrate 102 forming a hermetic seal between at least the enclosure body 116 and the substrate 102. In an embodiment, the sealant 122 may be at least partially disposed in the opening 118 to facilitate that the opening 118 is hermetically sealed.

In an embodiment, the sealant 122 includes cobalt. In an example, the sealant 122 consists essentially of cobalt (e.g., the sealant 122 includes substantially only cobalt and a chemically insignificant amount of impurities). In an example, the cobalt forms about 80 wt. % or greater of the sealant 122, such as about 85 wt. % or greater, about 90 wt. % or greater, about 95 wt. % or greater, about 97.5 wt. % or greater, about 98 wt. % or greater, or in ranges of about 80 wt. % to about 90 wt. %, about 85 wt. % to about 95 wt. %, about 90 wt. % to about 97%, about 95 wt. % to about 98 wt. %, or about 97 wt. % to about 99 wt. %. Generally, increasing the cobalt in the sealant 122 allows for better control of the melting temperature of the sealant 122. For example, materials other than cobalt in the sealant 122 may decrease or increase the melting temperature of the sealant 122 after the enclosure material diffuses into the sealant 122. The materials other than cobalt in the sealant 122 may cause the sealant 122 to melt (e.g., completely melt) at too low of a temperature (e.g., before the diamond material 110 degasses) or too high of a temperature.

In an embodiment, when the sealant 122 includes cobalt, the portions of the enclosure 112 that are adjacent to the sealant 122 may include niobium or tantalum. Niobium and tantalum are easily diffused into the cobalt. For example, heating the assembly 100 to a temperature that will degas the diamond material 110 (e.g., a temperature of about 1100° C. or greater, such as about 1100° C. to about 1300° C.) may cause diffusion of significant niobium or tantalum (e.g., a sufficient quantity to change the melting temperature of the sealant 122) into the cobalt. Pure cobalt exhibits a melting temperature of about 1495° C. Diffusing niobium or tantalum into the cobalt in sealant 122 may cause the melting temperature of the sealant 122 to decrease to 1239° C. to about 1400° C., such as about 1239° C. to about 1280° C., about 1250° C. to about 1300° C., about 1275° C. to about 1325° C., about 1300° C. to about 1350° C., about 1325° C. to about 1375° C., or about 1350° C. to about 1400° C.

The melting temperature of the sealant 122 may depend on whether the sealant 122 has niobium and/or tantalum diffused into the sealant 122 and the quantity of niobium and/or tantalum diffused into the sealant 122. In an example, when the enclosure 112 includes niobium, the sealant 122 may exhibit a solidus temperature of 1239° C. when niobium forms about 5.5 atomic percent ("at. %") to about 14 at. % of the sealant 122, a eutectic temperature of 1239° C. when niobium forms about 14 at. % of the sealant 122, and a solidus temperature of about 1264° C. when niobium forms about 14 at. % to about 25 at. % of the sealant 122. In such an example, the liquidus temperature of the sealant 122 may vary from about 1480° C. to 1240° C., depending on the niobium that is present in the sealant 122. In some embodiments, enough niobium may diffuse into the cobalt so the sealant 122 is at or near the eutectic composition (e.g., niobium forms about 12 at. % to about 16 at. % and, more particularly, about 14 at. % of the sealant 122) to reduce the liquidus temperature of the sealant 122 thereby reduce the temperature that the assembly 100 needs to be heated to melt all of the sealant 122. In an example, when the enclosure 112 includes tantalum, the sealant 122 may exhibit a solidus temperature of 1280° C. when tantalum forms about 4.5 at. % to about 8 at. % of the sealant 122, a eutectic temperature of 1280° C. when tantalum forms about 8 at. % of the sealant 122, and a solidus temperature of about 1280° C. when tantalum forms about 8 at. % to about 16.5 at. % of the sealant. In such an example, the liquidus temperature of the sealant 122 may vary from about 1495° C. to 1280° C., depending on the amount of tantalum that is present in the sealant 122. In some embodiments, enough tantalum may diffuse into the cobalt so the sealant 122 is at or near the eutectic composition (e.g., tantalum forms about 7 at. % to about 9 at. % and, more particularly, about 8 at. % of the sealant 122) to reduce the liquidus temperature of the sealant 122 thereby reduce the temperature that the assembly 100 needs to be heated to melt all of the sealant 122.

The sealant 122 needs to be in direct contact with at least a portion of the enclosure 112 for the enclosure material to diffuse into or alloy with the cobalt. In an embodiment, the sealant 122 may be configured to increase the rate at which the material of the enclosure 112 diffuses into or alloys with the cobalt. In such an embodiment, the sealant 122 may be a thin foil that is positioned between the portion of the enclosure body 116 that defines the opening 118 and the enclosure cap 120. For example, forming the sealant 122 into a thin foil and positioning the sealant 122 between the enclosure body 116 and the enclosure cap 120 increases the surface area of the sealant 122 and increases the percentage of the sealant 122 in direct contact with the enclosure 112. The rate of diffusion of the enclosure material into the sealant 122 may be proportional to the surface area of the sealant 122 that directly contacts the enclosure 112 and forming the sealant 122 into a thin foil and positioning the sealant 122 between the enclosure body 116 and the enclosure cap 120 may improve the rate of diffusion. Further, forming the sealant 122 into a thin foil reduces the distance between the enclosure 112 and any portion of the sealant 122. This reduces the distance that the enclosure material needs to diffuse/alloy into the sealant 122 thereby decreasing the time required to form a seal. Further, this reduced distance causes the composition of the sealant 122 to be more uniform throughout thereby reducing the likelihood that certain portions of the sealant 122 remain solid thereby inhibiting a hermetic seal.

In an embodiment, as previously discussed, the sealant 122 may include a copper-nickel alloy. As used herein, a copper-nickel alloy is a material that includes a majority copper and nickel (e.g., the copper and nickel collectively form about 50 wt. % to about 95 wt. % or 95 wt. % or greater of the copper-nickel alloy). However, the copper-nickel alloy may include other elements. In one example, such other elements may collectively form less than about 5 wt. % of the copper-nickel alloy. Examples of other elements that may be present in the copper-nickel alloy include iron and manganese. The copper in the copper-nickel alloy may reduce the melting temperature of the nickel. Meanwhile, the nickel in the copper-nickel alloy may allow the copper-nickel alloy to exhibit good wetting characteristics with the enclosure 112, which may allow the copper-nickel alloy to form a hermetic seal.

In an embodiment, copper may form about 50 wt. % to about 90 wt. % of the copper-nickel alloy, such as about 50 wt. % to about 60 wt. %, about 55 wt. % to about 65 wt. %, about 60 wt. % to about 70 wt. %, about 65 wt. % to about 75 wt. %, about 70 wt. % to about 80 wt. %, about 75 wt. % to about 85 wt. %, or about 80 wt. % to about 85 wt. %. In such an embodiment, the nickel may form about 8 wt. % to about 50 wt. % of the copper-nickel alloy, such as about 8 wt. % to about 15 wt. %, about 10 wt. % to about 20 wt. %, about 15 wt. % to about 25 wt. %, about 20 wt. % to about 30 wt. %, about 25 wt. % to about 35 wt. %, about 30 wt. % to about 40 wt. %, about 35 wt. % to about 45 wt. % or about 40 wt. % to about 50 wt. %. The amount of copper and nickel present in the copper-nickel alloy may depend on the temperature at which the diamond material 110 is degassed or otherwise heated/processed and the desired melting temperature of the copper-nickel alloy. In an example, the copper-nickel alloy may exhibit a liquidus temperature that is less than the temperature of the diamond degassing process when the copper-nickel alloy includes less than 15 wt. % nickel which may inhibit the degassing process. In an example, the copper-nickel alloy may exhibit a liquidus temperature that is sufficient to graphitize a meaningful portion of the diamond material 110 when nickel forms more than 40 wt. % or more than 50 wt. % of the copper-nickel alloy. Accordingly, in some embodiments, sealant 122 may comprise a copper-nickel alloy including between about 15 wt. % nickel to about 40 wt. % nickel. In an embodiment, the copper-nickel alloy may include 90/10 cupronickel (e.g., a copper-nickel alloy including 9 wt. % to 11 wt. % nickel, 1 wt. % to 2 wt. % iron, 0.3 wt. % to 1 wt. % iron, and the balance is copper) or 70/30 cupronickel (e.g., a copper-nickel alloy including 29 wt. % to 32 wt. % nickel, 0.5 wt. % to 1.5 wt. % iron, 0.4 wt. % to 1 wt. % manganese, and the balance is copper) since such copper-nickel alloys are commercially available in large quantities.

In an embodiment, the sealant 122 may include a conventional sealant, such as when the bottom surface 106 of the substrate 102 is concave. Examples of conventional sealants that may be used include conventional braze materials (e.g., braze material that include silicon and/or boron), solder, silicone, rubber, epoxy, or any other suitable sealant.

The assembly 100 may include at least one protectant 124. The protectant 124 may be applied to at least a portion of a surface of the substrate 102. For example, the protectant 124 may be applied to one or more of at least a portion of the lateral surface 108 of the substrate 102 or a portion of the bottom surface 106 of the substrate 102 that is adjacent to the enclosure body 116. The protectant 124 is configured to inhibit or prevent sealant 122 (upon melting) from adhering or wetting to a selected surfaces of the substrate 102. Protectant 124 may be known as a "stop-off" material. In an example, the protectants 124 includes at least one metallic-oxide powder (e.g., aluminum oxide, titanium oxide, yttrium-oxide, magnesium-oxide, or combinations thereof) that may be mixed with a liquid carrier solution. Further examples of protectants 124 are disclosed in U.S. Pat. No. 8,863,864 issued on Oct. 21, 2014, the disclosed of which is incorporated herein, in its entirety, by this reference.

The assembly 100 may include one or more additional components. In an embodiment, the assembly 100 may include a braze material (not shown) disposed between the substrate 102 and the diamond material 110, such as when the diamond material 110 includes a preformed PCD table. The braze material, when melted, may attach the preformed PCD table to the substrate 102. Examples of braze material that may be disposed between the substrate 102 and the diamond material 110 are disclosed in U.S. Pat. No. 8,236,074 filed on Oct. 10, 2006, the disclosure of which is incorporated herein, in its entirety, by this reference. In an embodiment, the assembly 100 may include a thin foil of catalyst material (e.g., one or more metal solvent catalysts, one or more alkali metal carbonates, and/or one or more alkaline earth metal carbonates) disposed adjacent to the diamond material 110. In such an embodiment, the catalyst material may sweep into the diamond material 110 during the HPHT process. In an embodiment, the assembly 100 may include an infiltrant material disposed adjacent to the diamond material 110, such as a thin foil of infiltrant material disposed adjacent to the diamond material 110. Examples of infiltrant materials and methods of infiltrating the diamond material 110 with the infiltrant materials that may be employed with any feature or embodiment disclosed herein are disclosed in U.S. Pat. No. 9,487,847 filed on Oct. 10, 2012, U.S. Pat. No. 9,945,186 filed on Jun. 13, 2014, U.S. Pat. No. 9,765,572 filed on Nov. 21, 2013, and U.S. Pat. No. 10,047,568 filed on Apr. 2, 2015, the disclosures of each of which are incorporated herein, in its entirety, by this reference.

Figure 1B:
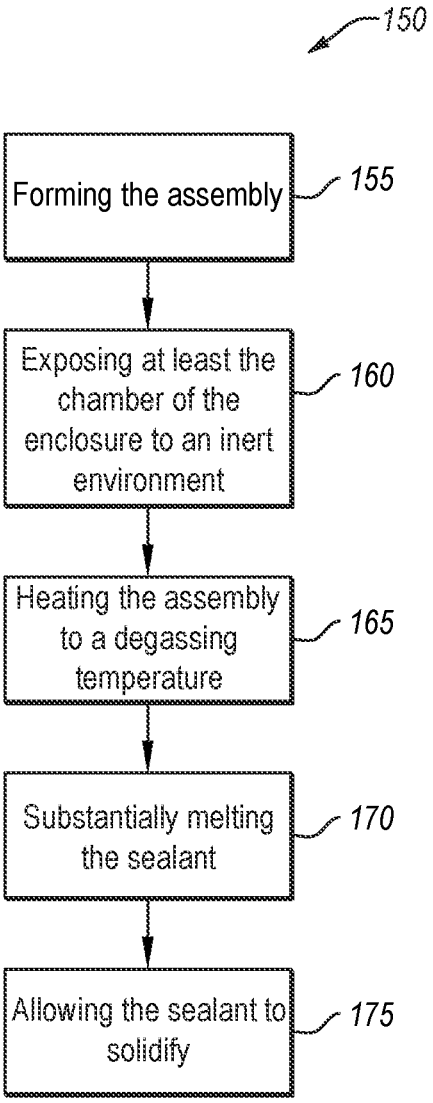
FIG. 1B is a flow chart of a method of forming the assembly and preparing the assembly for an HPHT process, according to an embodiment.

FIG. 1B is a flow chart of a method 150 of forming the assembly 100 and preparing the assembly 100 for an HPHT process, according to an embodiment. The method 150 includes one or more of act 155 of forming the assembly 100, act 160 of exposing the enclosure 112 to an inert environment, act 165 of heating the assembly 100 to a degassing temperature, act 170 of substantially melting the sealant 122, or act 175 of allowing the sealant 122 to solidify. It is noted that act 155, 160, 165, 170 and 175 are merely provided for illustrative purposes only. One or more of act 155, 160, 165, 170, or 175 may be performed in an order that is different than the order shown in FIG. 1B, combined with another act, separated into multiple acts, supplemented, modified, or omitted. It is noted that, after the method 150, the assembly 100 may be subjected to an HPHT process, which will be discussed in more detail with regards to FIG. 3.

Act 155 includes forming the assembly 100. As previously discussed, forming the assembly 100 may include disposing the substrate 102 and the diamond material 110 in the chamber 114 so the diamond material 110 is adjacent or proximate to the interfacial surface 104. Act 155 may also include disposing the sealant 122 in the chamber 114 and, when the enclosure 112 includes the enclosure cap 120, disposing the enclosure cap 120 over the opening 118 of the enclosure body 116. In an embodiment, act 115 may also include disposing one or more of at least one protectant 124, at least one braze material, at least one catalyst material, at least one infiltrant material, or any other component of the assembly 100 in the chamber 114.

After forming the assembly 100, the method 150 may include act 160. Act 160 includes exposing at least the chamber 114 of the enclosure 112 to an inert environment. The phrase "inert environment," as used herein, means an environment that inhibits oxidation. Explaining further, an inert environment may be, for instance, at least substantially devoid of oxygen. In an embodiment, the inert environment includes creating a vacuum (i.e., generating a pressure less than an ambient atmospheric pressure), such as an absolute pressure (e.g., pressure above a perfect vacuum) of about 25 Torr to about 700 Torr, about $1\times10^{-3}$ Torr to about 25 Torr, or about $1\times10^{-3}$ Torr to about $1\times10^{-9}$ Torr. The vacuum may also facilitate degassing of the diamond material 110 by removing at least some gases or molecules that are present in or attached to the diamond material 110 (e.g., the gases absorbed by the diamond material 110). In an embodiment, the inert environment includes one or more noble or inert gases (e.g., argon, nitrogen, or helium).

Further, after forming the assembly 100 (e.g., during act 160), the method 150 may include act 165. Act 165 includes heating the assembly 100 to a degassing temperature. The degassing temperature is selected to remove at least some gases that are present in the diamond material 110. In an embodiment, the degassing temperature is about 1100° C. or greater, about 1150° C. or greater, about 1200° C. or greater, about 1250° C. or greater, about 1300° C. or greater, or in ranges of about 1100° C. to about 1200° C., about 1150° C. to about 1250° C., about 1200° C. to about 1300° C., about 1200° C. to about 1250° C., about 1220° C. to about 1240° C., about 1250° C. to about 1350° C., about 1300° C. to about 1400° C., about 1350° C. to about 1400° C., or about 1300° to about 1350° C. The degassing temperature may be selected based on several factors.

In an embodiment, the degassing temperature may be selected based on the average grain size of the mass of diamond particles. The amount of gases absorbed by the diamond material 110 (e.g., the mass of diamond particles) corresponds to the average particle size of the diamond material 110. Decreasing the average particle size of the diamond material 110 increases the surface area of the diamond material 110 which increases the amount of gases absorbed by the diamond material 110. Increasing the amount of gases absorbed by the diamond material 110 may require increasing the degassing temperature to efficiently remove the absorbed gases. For example, the degassing temperature may be greater than about 1200° C., and more particularly about 1220° C. to about 1250° C., to remove absorbed gases from fine diamond grains (e.g., diamond grains exhibiting an average grain size that is less than about 30 μm or less than about 20 μm). The cobalt and copper-nickel sealants 122 may allow for removal of the absorbed gases at relatively high temperatures since the cobalt and copper-nickel sealants 122 may at least partially remain in a solid state for a period during which the absorbed gases may be removed from the diamond material 110. Further, the cobalt and copper-nickel sealants 122 may be melted by either maintaining the degassing temperature or heating the assembly 100 to a slightly higher second temperature.

In an embodiment, the degassing temperature may be selected based on the composition of the sealant 122. Generally, the degassing temperature is selected so the sealant 122 is at least partially solid for a period that will remove the gases from the diamond material 110 since the lack of solid particles may inhibit degassing of the diamond material 110. The degassing temperature is selected to be less than the melting temperature, and more particularly, less than the liquidus temperature. In an embodiment, the degassing temperature may be selected to be less than the solidus temperature of the sealant 122. In some examples, the degassing temperature may be selected to be sufficiently high to cause the enclosure material to alloy with and/or diffuse into the sealant 122. Optionally, the degassing temperature may be greater than a melting temperature (e.g., liquidus or eutectic temperature) of the alloy formed by the enclosure material into the sealant 122 thereby mitigating the need to heat the assembly 100 to a higher temperature to melt the sealant 122.

After removing at least some gases from the diamond material 110, the method may include act 170. Act 170 includes substantially melting the sealant 122 to seal the enclosure 112. How the sealant 122 is melted may depend on the composition of the sealant 122. When the sealant 122 includes cobalt, the enclosure material (e.g., niobium and/or tantalum) is diffused from and/or alloy with the enclosure 112 to decrease the melting temperature of the sealant 122. In an embodiment, the sealant 122 is substantially melted by maintaining the assembly 100 at the degassing temperature until a sufficient quantity of the enclosure material has diffused into and/or alloyed with the cobalt that the melting temperature (e.g., liquidus or eutectic temperature) of the sealant 122 is at or below the first temperature. In an embodiment, the sealant 122 is substantially melted by maintaining the assembly 100 at the degassing temperature and then increasing the temperature of the assembly 100 to another temperature that is greater than the degassing temperature. The greater temperature is selected to substantially melt the sealant 122. Such greater temperature may be about 1240° C. or greater, about 1250° C. or greater, about 1275° C. or greater, about 1300° C. or greater, about 1350° C. or greater, about 1240° C. to about 1275° C., about 1250° C. to about 1300° C., about 1275° C. to about 1350° C., or about 1300° C. to about 1400° C. The greater temperature may be greater than the degassing temperature by about 5° C. or more, about 10° C. or more, about 20° C. or more, about 35° C. or more, about 50° C. or more, about 75° C. or more, about 100° C. or more, about 150° C. or more, about 200° C. or more, or in ranges of about 5° C. to about 20° C., about 10° C. to about 35° C., about 20° C. to about 50° C., about 35° C. to about 75° C., about 50° C. to about 100° C., about 75° C. to about 150° C., or about 100° C. to about 200° C.

The greater temperature and the difference between the degassing temperature and the greater temperature may be selected based on how much enclosure material is expected to diffuse into the cobalt (e.g., the expected final composition of the sealant 122), how uniformly the enclosure material is expected to diffuse into and/or alloy with the cobalt, the difference between the degassing temperature and the melting temperature of the sealant 122, and how must time is required to substantially melt the sealant 122.

When the sealant 122 includes a copper-nickel alloy, substantially melting the sealant 122 includes heating the sealant 122 to a greater temperature above the liquidus temperature of the sealant 122. For example, the greater temperature and the difference between the degassing temperature and the greater temperature may be the same as the greater temperatures and differences between the degassing and greater temperatures discussed above. The greater temperature and the difference between the degassing and greater temperatures may depend on the amount of cobalt and nickel in the copper-nickel alloy, the difference between the degassing temperature and the melting temperature of the sealant 122, and how must time is required to substantially melt the sealant 122. In an embodiment, the degassing temperature may be greater than the solidus temperature of the copper-nickel alloy and at least some of the copper-nickel alloy may be partially melted when the assembly 100 is heated to the greater temperature. However, the greater temperature is selected to be at or greater than the liquidus temperature of the copper-nickel alloy thereby substantially melting the copper-nickel alloy.

After act 170, the method 150 may include act 175. Act 175 includes solidifying the sealant 122. Solidifying the sealant 122 allows the sealant to form and maintain a hermetic seal thereby maintaining the inert environment in the chamber 114. Generally, solidifying the sealant 122 includes cooling the assembly 100 to a temperature below the melting temperature of the sealant 122. In an embodiment, cooling the assembly 100 includes cooling the assembly 100 to room temperature thereby allowing the assembly 100 to be easily handled. In an embodiment, cooling the assembly 100 includes decreases the temperature of the furnace or heating element that heats the assembly 100 (e.g., the assembly 100 may be cooled to a temperature that is greater than room temperature). It is noted that, when the sealant 122 includes cobalt, solidifying the sealant 122 may include allowing the enclosure material to continue to diffuse into and/or alloy with the cobalt until the amount of enclosure material in the sealant 122 is about, at, or above the eutectic composition (e.g., 14 at. % for niobium and 8 at. % for tantalum). Increasing the amount of the enclosure material in the sealant 122 above the eutectic composition may increase the liquidus temperature of the sealant 122 and may even increase the solidus temperature of the sealant 122. In other words, the assembly 100 may not need to be cooled to solidify the sealant 122.

Figure 1C:
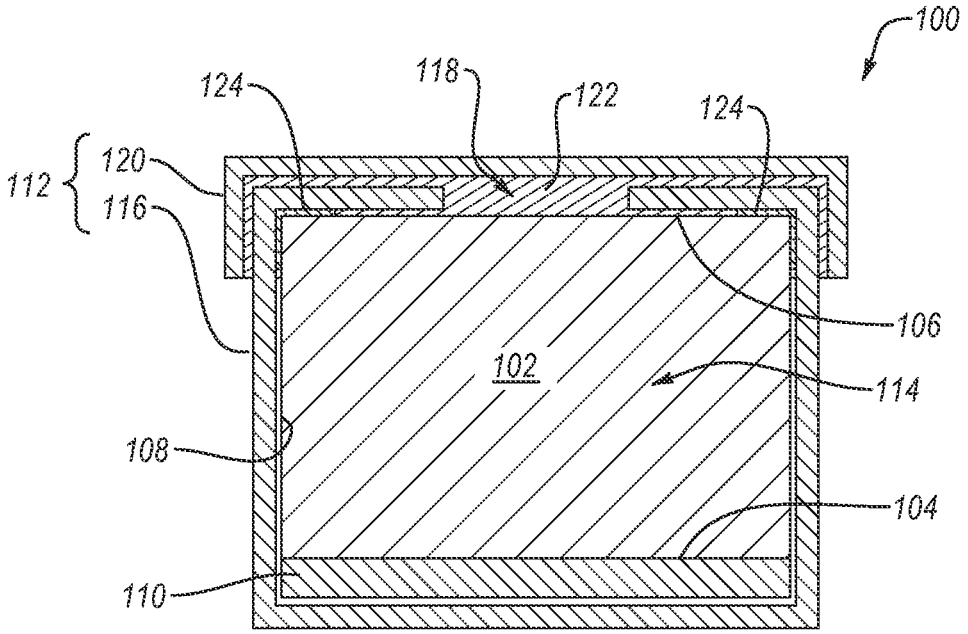
FIG. 1C is a cross-sectional view of the assembly after the method of FIG. 1B, according to an embodiment.

FIG. 1C is a cross-sectional view of the assembly 100 after the method 150, according to an embodiment. As shown in FIG. 1C, the sealant 122 may at least partially occupy portions of the chamber 114 when the sealant 122 melted. For example, the sealant 122 may occupy the portions of the chamber 114 between the portions of the enclosure body 116 that define the opening 118 and the enclosure cap 120 since, as illustrated in FIG. 1A, this is location that the sealant 122 originally occupied. The sealant 122 may form a hermetic seal. However, the sealant 122 may also occupy portions of the chamber 114 spaced from the location that the sealant 122 originally occupied. For example, as illustrated, the sealant 122 may occupy the opening 118, the portions of the chamber 114 not obstructed by the protectant 124 between the substrate 102 and the enclosure body 116, and portions of the chamber 114 between portions of the enclosure body 116 that do not define the opening 118 and the enclosure cap 120. Generally, increasing the volume of the chamber 114 occupied by the sealant 122 may improve the hermetic seal formed by the sealant 122 and may mitigate any effects caused by the sealant 122 cracking. Further, in some embodiments, the ability of the sealant 122 to spread within the chamber and form a hermetic seal is directly proportional to the ability of the sealant 122 to wet the enclosure 112. For example, the cobalt and copper-nickel alloy sealants disclosed herein may exhibit good wetting characteristics with several enclosure materials, such as steel, niobium, and tantalum, allowing the cobalt and copper-nickel alloy sealants disclosed herein to form good hermetic seals.

FIGS. 1A and 1C illustrate one example of an enclosure that may be used in any of the assemblies disclosed herein. However, it is noted that other enclosures may be used to form any of the assemblies disclosed herein. FIGS. 2A to 2D are cross-sectional schematics of different assemblies that each includes a different enclosure, according to different embodiments. Except as otherwise disclosed herein, the assemblies illustrated in FIGS. 2A to 2D are the same or substantially similar to any of the assemblies disclosed herein.

Figure 2A:
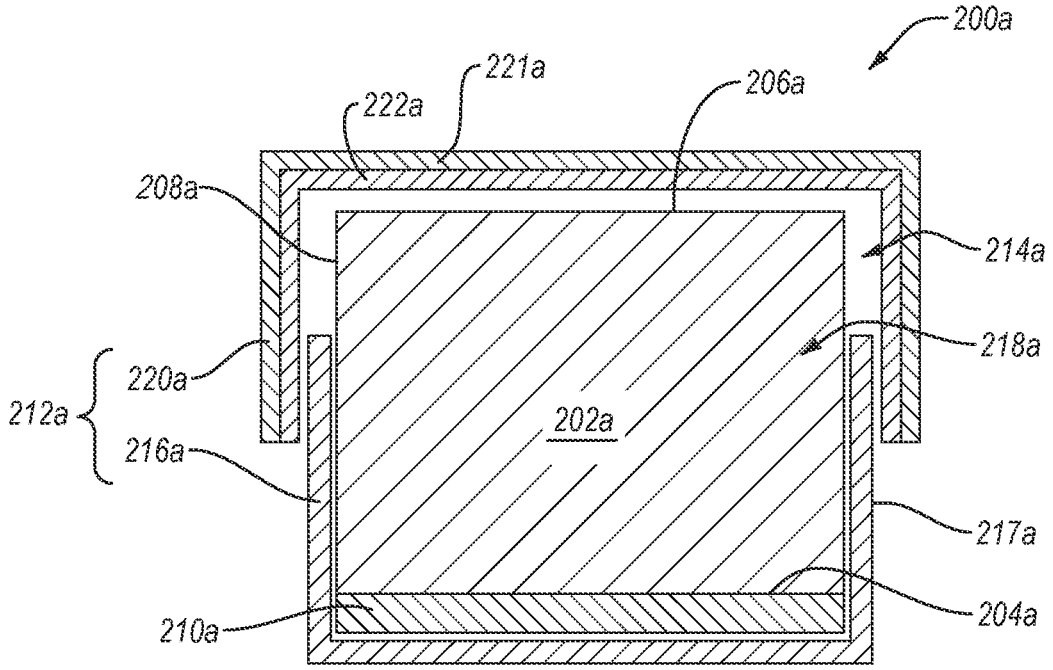
FIGS. 2A to 2D are cross-sectional schematics of different assemblies that each includes a different enclosure, according to different embodiments.

Referring to FIG. 2A, the assembly 200*a* may include a substrate 202*a* that includes an interfacial surface 204*a*, a bottom surface 206*a*, and at least one lateral surface 208*a*. The assembly 200*a* also may include diamond material 210*a* adjacent to the interfacial surface 204*a*. The assembly 200*a* may include an enclosure 212*a* defining a chamber 214*a*. The substrate 202*a* and the diamond material 210*a* may be positioned in the chamber 214*a*.

The enclosure 212*a* may include an enclosure body 216*a* defining an opening 218*a*. The enclosure body 216*a* may extend around the diamond material 210*a* and a portion of the substrate 202*a*. The portions of the enclosure body 216*a* that define the opening 218*a* may terminate adjacent to the lateral surface 208*a* of the substrate 202*a* instead of adjacent to the bottom surface 206*a* (as shown in FIGS. 1A and 1C). The enclosure 212*a* may also include an enclosure cap 220*a*. The enclosure cap 220*a* may be configured to extend around the bottom surface 206*a* and at least a portion of the lateral surface 208*a* of the substrate 202*a* and overlap and cover a portion of the enclosure body 212*a*.

The assembly 200*a* may include a sealant 222*a* that is the same or substantially similar to any of the sealants 222*a* disclosed herein. The sealant 222*a* may be disposed between at least a portion of the enclosure body 216*a* and the enclosure cap 222*a* that are adjacent to each other when the assembly 200*a* is fully assembled. In an example, as shown, the sealant 222*a* may be disposed on (e.g., coat) at least a portion of an inner surface 221*a* the enclosure cap 220*a* that is adjacent to the enclosure body 216*a* when the assembly 200*a* is fully assembled. In such an example, the sealant 222*a* may be disposed on substantially all of the inner surface 221*a* of the enclosure cap 220*a* which may improve a hermetic seal formed when the sealant 222*a* substantially melts. In an example, the sealant 222*a* may be disposed on (e.g., coat) at least a portion of the outer surface 217*a* that is adjacent to the enclosure cap 220*a*.

Figure 2B:
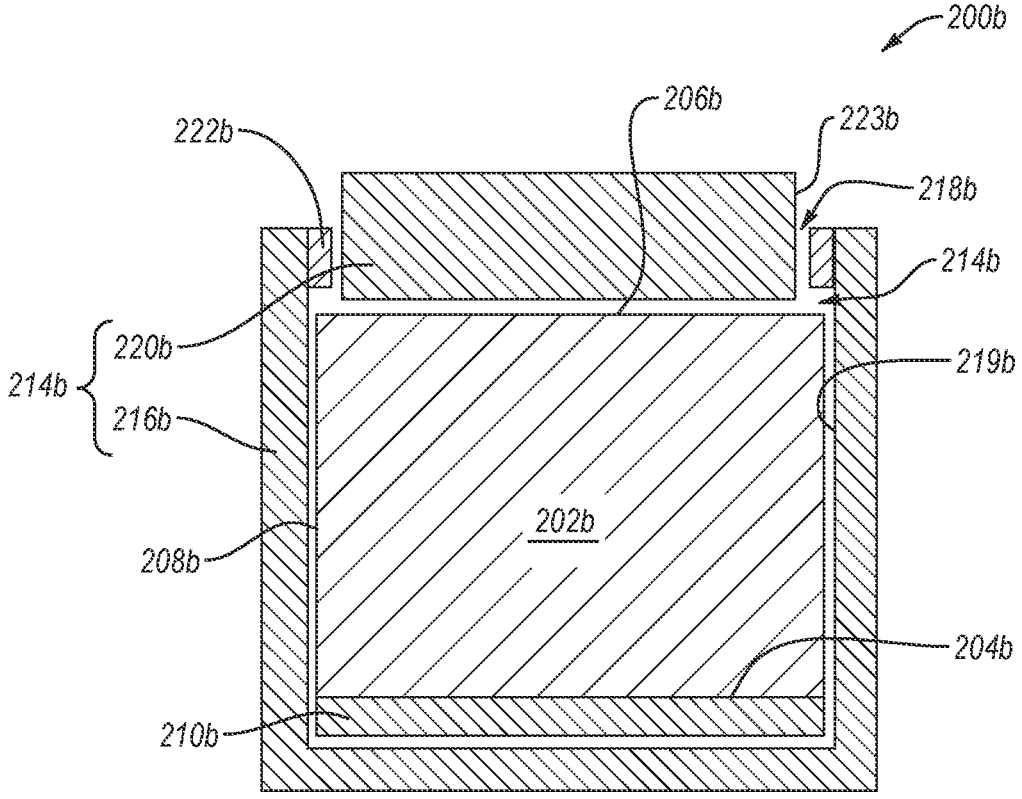

Referring to FIG. 2B, the assembly 200*b* may include a substrate 202*b* including an interfacial surface 204*b*, a bottom surface 206*b*, and at least one lateral surface 208*b*.

The assembly 200*b* may also include diamond material 210*b* positioned adjacent to the interfacial surface 204*b*. The assembly 200*b* may include an enclosure 212*b* defining a chamber 214*b*. The substrate 202*b* and the diamond material 210*b* may be positioned in the chamber 214*b*.

The enclosure 212*b* may include an enclosure body 216*b* defining an opening 218*b*. The enclosure body 216*b* may extend around the diamond material 210*b*, all of the lateral surface 208*b* of the substrate 202*b*, and past the bottom surface 206*b* of the substrate 202*b*. In an embodiment, as shown, the enclosure body 216*b* does not cover a portion of the bottom surface 206*b* of the substrate 202*b*. In an embodiment, the enclosure body 216*b* may cover a portion of the bottom surface 206*b*, as shown in FIGS. 1A and 1C. The enclosure 212*b* may also include an enclosure cap 220*b*. The enclosure cap 220*b* may be configured to at least partially fit within the opening 218*b*. The enclosure cap 220*b* may exhibit a size and shape that substantially corresponds to the size and shape of the opening 218*b* thereby facilitating making a hermetic seal.

The assembly 200*b* may include a sealant 222*b* that is the same or substantially similar to any of the sealants 222*b* disclosed herein. The sealant 222*b* may be disposed between at least a portion of the enclosure body 216*b* and the enclosure cap 222*b* that are adjacent to each other when the assembly 200*b* is fully assembled. In an example, as shown, the sealant 222*b* may be disposed on (e.g., coat) at least a portion of an outer surface 219*b* of the enclosure body 216*b* that is adjacent to the enclosure cap 220*b* when the assembly 200*b* is fully assembled. In an example, the sealant 222*b* may be disposed on (e.g., coat) at least a portion of the outer surface 223*b* of the enclosure cap 220*b* that is adjacent to the enclosure body 216*b* when the assembly 200*b* is fully assembled.

Figure 2C:
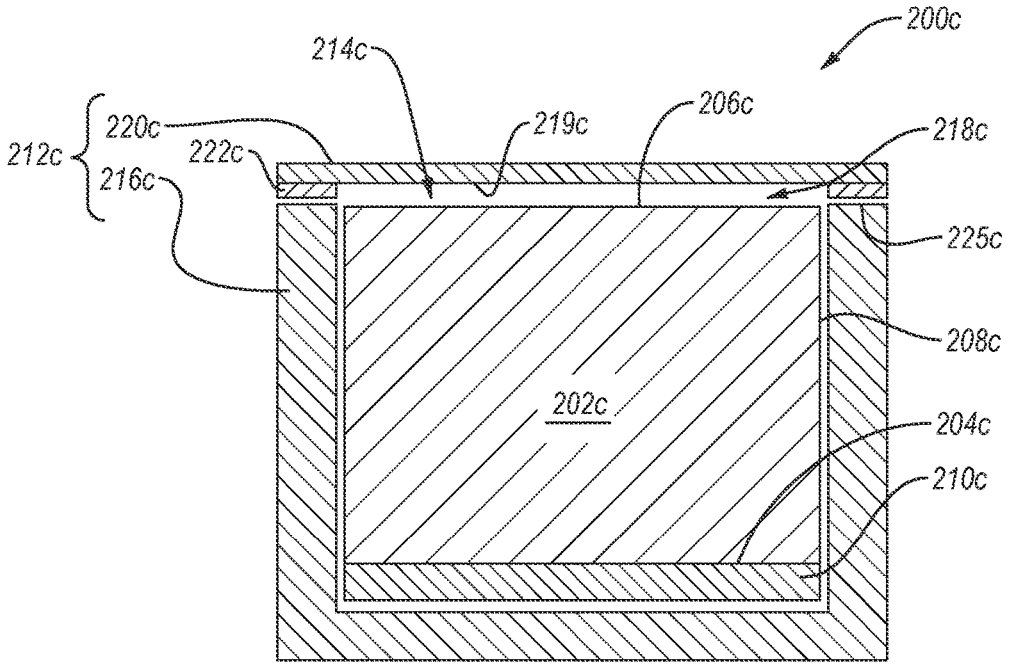

Referring to FIG. 2C, the assembly 200*c* may include a substrate 202*c* including an interfacial surface 204*c*, a bottom surface 206*c*, and at least one lateral surface 208*c*. The assembly 200*c* may also include diamond material 210*c* adjacent to the interfacial surface 204*c*. The assembly 200*c* may include an enclosure 212*c* defining a chamber 214*c*. The substrate 202*c* and the diamond material 210*c* may be positioned in the chamber 214*c*.

The enclosure 212*c* may include an enclosure body 216*c* defining an opening 218*c*. The enclosure body 216*c* may extend around the diamond material 210*c* and all of the lateral surface 208*c* of the substrate 202*c*. In an embodiment, as shown, the enclosure body 216*c* does not cover a portion of the bottom surface 206*c* of the substrate 202*c*. In an embodiment, the enclosure body 216*c* may cover a portion of the bottom surface 206*c*, as shown in FIGS. 1A and 1C. The enclosure 212*c* may also include an enclosure cap 220*c*. The enclosure cap 220*c* may be configured to positioned adjacent to an outermost edge 225*c* of the enclosure body 216*c*. Since the enclosure cap 220*c* is positioned adjacent to the outermost edge 225*c*, in some examples, the enclosure cap 220*c* may be generally planar (e.g., a disk).

The assembly 200*c* may include a sealant 222*c* that is the same or substantially similar to any of the sealants 222*c* disclosed herein. The sealant 222*c* may be disposed between at least a portion of the enclosure body 216*c* and the enclosure cap 222*c* that are adjacent to each other when the assembly 200*c* is fully assembled. In an example, as shown, the sealant 222*c* may be at least disposed on (e.g., coat) at least a portion of the inner surface 219*c* of the enclosure cap 220*c* that is adjacent to the outermost edge 225*c* of the enclosure body 216*c* when the assembly 200*c* is fully assembled. In an example, the sealant 222*c* may be disposed on (e.g., coat) at least a portion of the outermost edge 225*c* of the enclosure body 216*c* that is adjacent to the enclosure cap 220*c* when the assembly 200*c* is fully assembled.

Figure 2D:
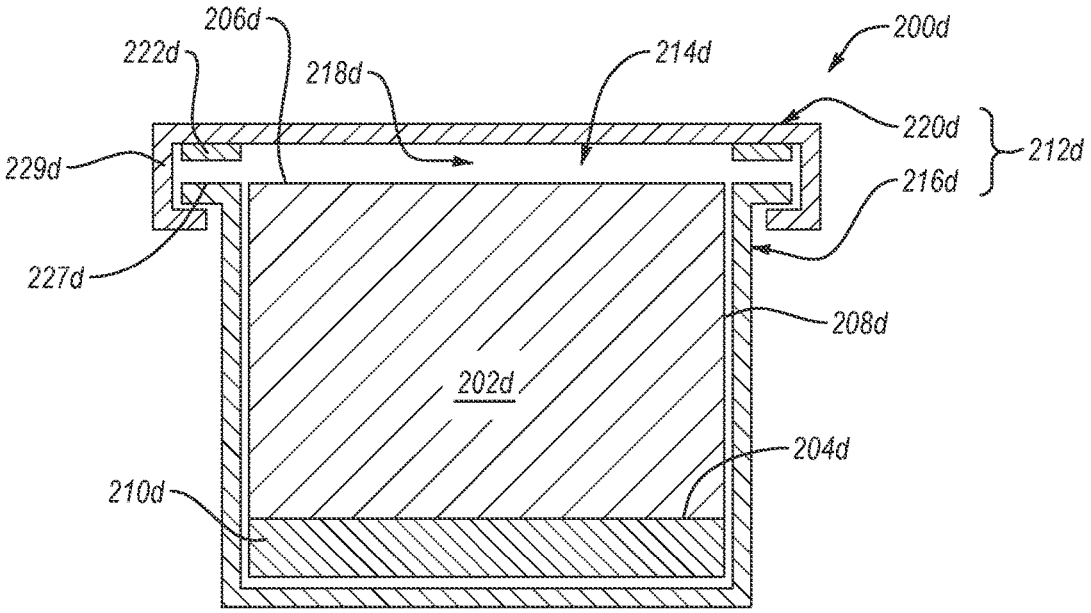

Referring to FIG. 2D, the assembly 200*d* may include a substrate 202*d* including an interfacial surface 204*d*, a bottom surface 206*d*, and at least one lateral surface 208*d*. The assembly 200*d* may also include diamond material 210*d* adjacent to the interfacial surface 204*d*. The assembly 200*d* may include an enclosure 212*d* defining a chamber 214*d*. The substrate 202*d* and the diamond material 210*d* may be positioned in the chamber 214*d*.

The enclosure 212*d* may include an enclosure body 216*d* defining an opening 218*d*. The enclosure body 216*d* may extend around the diamond material 210*d* and at least a portion of the lateral surface 208*d* of the substrate 202*d*. In some embodiments, the enclosure body 216*d* may cover a portion of the bottom surface 206*d*, as shown in FIGS. 1A and 1C. The enclosure body 216*d* may also include at least one protrusion 227*d* extending outwardly (e.g., extending radially outwardly). The protrusion 227*d* may extend outwards from a portion of the enclosure body 216*d* that defines the opening 216*d* or a region thereabout. The enclosure 212*d* may also include an enclosure cap 220*d*. The enclosure cap 220*b* may be configured to cover the opening 216*d* and the extend around at least a portion of the protrusion 227*d*. For example, as shown, the end 229*d* of the enclosure cap 220*d* may, in a cross-sectional view, exhibit a generally n-like shape thereby allowing the enclosure cap 220*d* to extend around at least a portion of the protrusion 227*d*. In such an example, the end 229*d* of the enclosure cap 220*d* may allow the enclosure cap 220*d* to be crimped around the protrusion 227*d*. Crimping the enclosure cap 220*d* around the protrusion 227*d* may at least one of facilitate formation of a hermetic seal by decreasing the volume of chamber 214*d* that sealants 222*d* needs to occupy to form the hermetic seal or more securely attach the enclosure cap 220*d* to the enclosure body 216*d*.

The assembly 200*d* may also a sealant 222*d* that is the same or substantially similar to any of the sealants 222*d* disclosed herein. The sealant 222*d* may disposed between at least a portion of the enclosure body 216*d* and the enclosure cap 222*d* that are adjacent to each other when the assembly 200*b* is fully assembled (e.g., at least between a portion of the protrusion 227*d* and the at least a portion of the end 229*d*). In an example, as shown, the sealant 222*d* may be disposed on (e.g., coat) at least a portion of the outer surface 223*d* of the enclosure cap 220*d* that is adjacent to the enclosure body 216*d* when the assembly 200*d* is fully assembled. In an example, the sealant 222*d* may be disposed on (e.g., coat) at least a portion of an outer surface 219*d* of the enclosure body 216*d* that is adjacent to the enclosure cap 220*d* when the assembly 200*b* is fully assembled.

Figure 3:
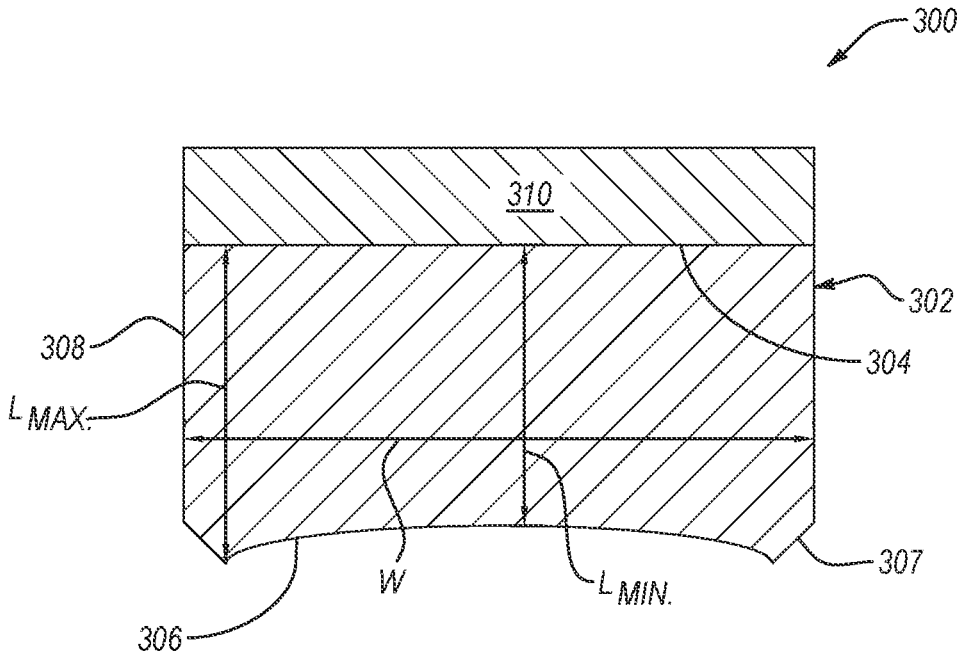
FIG. 3 is a schematic cross-sectional view of a portion of an assembly, according to an embodiment.

FIG. 3 is a schematic cross-sectional view of a portion of an assembly 300, according to an embodiment. Except as otherwise disclosed herein, the assembly 300 is the same or substantially similar to any of the assemblies disclosed herein (e.g., assembly 100). For example, the assembly 300 includes a substrate 302 having an interfacial surface 304, a bottom surface 306, and at least one lateral surface 308. The assembly 300 also includes diamond material 310 (e.g., a mass of diamond particles or a pre-formed PCD table) disposed adjacent or proximate to the interfacial surface 304. Although not shown for clarity, the assembly 300 may also include an enclosure, a sealant, and/or any of the other components disclose herein. Further, the assembly 300 may be formed and processed using any of the methods disclosed herein (e.g., method 150 of FIG. 1B).

The substrate 302 may include a concave bottom surface 306. The bottom surface 306 of the substrate 302 is concave to counteract warping caused in response to the HPHT process. For example, during the HPHT process, the substrate 302 is bonded to a PCD table formed from the diamond material 310. The substrate 302 and the PCD table exhibit different coefficients of thermal expansion. Cooling the substrate 302 and the PCD table causes both the substrate 302 and the PCD table to warp. Cooling may cause a top surface of the PCD table to bow inwardly (e.g., form a concave top surface if the PCD table is initially planar) and the bottom surface 306 to bow outwardly However, the concave bottom surface 306 of the substrate 302 may be selected to accommodate or counteract the outwardly bowing of the bottom surface 306. In other words, the bottom surface 306 of the substrate 302 may be substantially flat or may remain concave after the bottom surface 306 bows outwardly.

The substrate 302 exhibits a maximum width W (e.g., diameter when the substrate 302 is cylindrical) measured between the lateral surface 308 and a maximum length $L_{MAX}$ measured from the interfacial surface 304 to the bottom surface 306. Although interfacial surface 304 is depicted as a straight line, it should be noted that the interfacial surface 304 may exhibit features that cause the cross-sectional shape to be varied according to its shape. Therefore, it should be understood that maximum length $L_{MAX}$ may be influenced by the shape of bottom surface 306 as well as the shape of interfacial surface 304, without limitation. The inventors currently believe that warping (e.g., bowing) that occurs in the bottom surface 306 of the substrate 302 depends on the maximum width W relative to the maximum width $L_{MAX}$. For example, generally, the amount of warping in the bottom surface 306 of the substrate 302 is insignificant for post-HPHT sintering processes when the maximum width W of the substrate 302 is less than 1.5 the maximum length $L_{MAX}$ of the substrate 302. However, when the maximum width W of the substrate 302 is at least 1.5 times greater than the maximum length $L_{MAX}$, the bottom surface 306 is likely to significantly warp (e.g., exhibit a concave shape) under such circumstances. In particular, the bottom surface 306 may be concave when the maximum width W of the substrate 302 is between at least 2 times greater to at least 4 times greater than the maximum length $L_{MAX}$. The inventors currently believed the amount of warping may increase as a function of increasing ratio of $W/L_{MAX}$. However, it is noted that, sometimes, the amount of warping in the bottom surface 306 may be significant for post-HPHT sintering process when the maximum width W is less than 1.5 the maximum length $L_{MAX}$, such as when the assembly 300 is subject to an exceptionally high sintering temperature. Accordingly, in some embodiments, the bottom surface 306 may be concave even when the maximum width W is less than 1.5 the maximum length $L_{MAX}$.

The substrate 302 exhibits a minimum length $L_{MIN}$ measured from the interfacial surface 304 to the bottom surface 306. Although interfacial surface 304 is depicted as a straight line, it should be noted that the interfacial surface 304 may exhibit features that cause the cross-sectional shape to be varied according to its shape. Therefore, it should be understood that minimum length $L_{MIN}$ may be influenced by the shape of bottom surface 306 as well as the shape of interfacial surface 304, without limitation. As shown, the minimum length $L_{MIN}$ is parallel to the maximum length $L_{MAX}$. As shown in FIG. 3, the maximum length $L_{MAX}$ is closer to the lateral surface 308 than the minimum length $L_{MIN}$. When the substrate 302 includes a chamfer 307, the minimum length $L_{MIN}$ is not measured from the chamfer 307. The concavity of the bottom surface 306 (e.g., the maximum distance that the concave bottom surface 306 varies from a planar bottom surface) means the difference between the maximum length $L_{MAX}$ and the minimum length $L_{MIN}$. In an example, the concavity of the bottom surface 306 is about 100 μm or more, 125 μm or more, about 150 μm or more, about 175 μm or more, about 200 μm or more, about 225 μm or more, about 250 μm or more, about 300 μm or more, about 350 μm or more, about 400 μm or more, about 500 μm or more, about 700 μm or more, about 1 mm or more, or in ranges of about 100 μm to about 150 μm, about 125 micro to about 175 μm, about 150 μm to about 200 μm, about 175 μm to about 225 μm, about 200 μm to about 250 μm, about 225 μm to about 300 μm, about 250 μm to about 350 μm, about 300 μm to about 400 μm, about 350 μm to about 500 μm, about 400 μm to about 700 μm, or about 500 μm to about 1 mm. In an example, the concavity of the bottom surface 306 may exhibit a radius of curvature of about 30 mm to about 8 m, such as about 30 mm to about 50 mm, about 40 mm to about 70 mm, about 60 mm to about 100 mm, about 75 mm to about 125 mm, about 100 mm to about 200 mm, about 150 mm to about 300 mm, about 200 mm to about 400 mm, about 300 mm to about 600 mm, about 500 mm to about 1 mm, about 700 mm to about 1.5 m, about 1 m to about 2 m, about 1.5 m to about 3 m, about 2 m to about 4 m, about 3 m to about 5 m, about 4 m to about 6 m, about 5 m to about 7 m, or about 6 m to about 8 m.

The concavity of the bottom surface 306 may be selected so the bottom surface 306 is substantially or actually likely to be substantially flat or concave after the HPHT process. The concavity of the bottom surface 306 may be selected based on several factors. In an example, the concavity of the bottom surface 306 may be selected based on the ratio of the maximum width W to the maximum length $L_{MAX}$ of the substrate 302 since, as previously discussed, the amount of warping in the bottom surface 306 may depend, at least in part, on the maximum width W and the maximum length $L_{MAX}$. For instance, increasing the maximum width W relative to the maximum Length $L_{MAX}$ may generally require the concavity of the bottom surface 306 to be increased and vice versa. In an example, the concavity of the bottom surface 306 may depend on the actual maximum width W and maximum length $L_{MAX}$, wherein increasing the maximum width W and the maximum length $L_{MAX}$ may include increasing the concavity of the bottom surface 306 and vice versa. For instance, the concavity of the bottom surface 306 may be about 225 μm or less when the maximum width W is about 19 mm and the maximum length $L_{MAX}$ is about 9.5 mm since such concavity of the bottom surface 306 may typically result in a flat or concave bottom surface 306 after an HPHT process. Meanwhile, the concavity of the bottom surface 306 is greater than about 225 μm when the maximum width W is about 25.4 mm and the maximum length $L_{MAX}$ is about 12.7 mm. In an example, the concavity of the bottom surface 306 may depend on the temperature of the HPHT process since increasing the temperature of the HPHT process generally increases the warping in the bottom surface 306 and vice versa. Increasing the temperature of the HPHT process may include increasing the concavity of the bottom surface 306 and vice versa.

Figure 4:
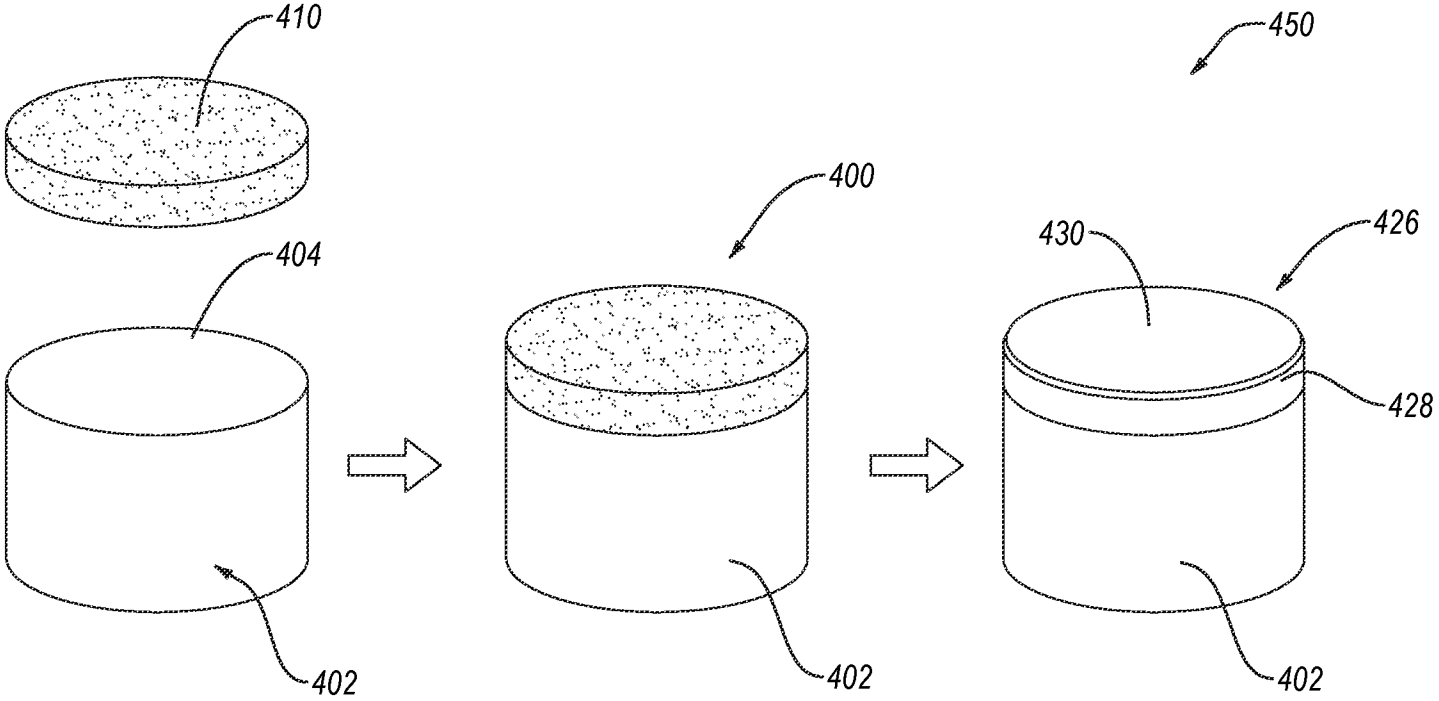
FIG. 4 is a schematic illustration of a method to form a PDC in an HPHT process using any of the assemblies disclosed herein, according to an embodiment.

FIG. 4 is a schematic illustration of a method 450 to form a PDC 426 in an HPHT process using any of the assemblies disclosed herein, according to an embodiment. The method 450 includes disposing a diamond material 410 adjacent to or proximate to an interfacial surface 404 of a substrate 402. The substrate 402 and the diamond material 410 may include any of the substrates and/or diamond materials disclosed herein, respectively. The substrate 402 and the diamond material 410 may be formed into an assembly 400 including any of the features of one or more of assemblies 100-300, as previously discussed herein. For example, the substrate 402 and the diamond material 410 may be disposed in a chamber defined by an enclosure (not shown for clarity) and a sealant may also be disposed in the chamber. The assembly 400 may then be hermetically sealed as previously discussed herein.

The assembly 400 is subjected to an HPHT process using an ultra-high pressure press at a temperature of at least about 1000° C. (e.g., about 1100° C. to about 2200° C. or about 1200° C. to about 1450° C.) and a pressure in the pressure transmitting medium of at least about 4.0 GPa (e.g., about 5.0 GPa to about 12.0 GPa, about 7.5 GPa to about 15 GPa, about 7.5 GPa to about 10 GPa, or about 8.0 GPa to about 10 GPa) for a time sufficient to bond the diamond material 410 to the substrate 402. When the diamond material 410 includes a mass of diamond particles, the HPHT process sinters the diamond particles together in the presence of a catalyst (e.g., metal-solvent catalyst) to form a PCD table 428 comprising bonded diamond grains defining interstitial regions occupied by the catalyst. For example, the pressure in the pressure transmitting medium employed in the HPHT process may be at least at least about 5 GPa, at least about 6 GPa, at least about 7.5 GPa, at least about 8.0 GPa, at least about 9.0 GPa, at least about 10.0 GPa, at least about 11.0 GPa, at least about 12.0 GPa, or at least about 14 GPa.

The pressure values employed in the HPHT processes disclosed herein refer to the pressure in the pressure transmitting medium at room temperature (e.g., about 25° Celsius) with application of pressure using an ultra-high pressure press and not the pressure applied to exterior of the cell assembly 436. This is known as the "cell pressure." The actual pressure in the pressure transmitting medium at sintering temperature may be slightly higher. The ultra-high pressure press may be calibrated at room temperature by embedding at least one calibration material that changes structure at a known pressure such as, PbTe, thallium, barium, or bismuth in the pressure transmitting medium. Further, optionally, a change in resistance may be measured across the at least one calibration material due to a phase change thereof. For example, PbTe exhibits a phase change at room temperature at about 6.0 GPa and bismuth exhibits a phase change at room temperature at about 7.7 GPa. Examples of suitable pressure calibration techniques are disclosed in G. Rousse, S. Klotz, A. M. Saitta, J. Rodriguez-Carvajal, M. I. McMahon, B. Couzinet, and M. Mezouar, "Structure of the Intermediate Phase of PbTe at High Pressure," Physical Review B: Condensed Matter and Materials Physics, 71, 224116 (2005) and D. L. Decker, W. A. Bassett, L. Merrill, H. T. Hall, and J. D. Barnett, "High-Pressure Calibration: A Critical Review," J. Phys. Chem. Ref. Data, 1, 3 (1972).

During the HPHT process, a catalyst (e.g., cobalt, iron, nickel, alloys thereof, or combinations thereof) may infiltrate the mass of diamond particles 434 and facilitate diamond-to-diamond bonding between the diamond particles. In an embodiment, the catalyst may be provided from the substrate 402. In such an embodiment, the substrate 402 may include a metal-solvent catalyst (e.g., cobalt, nickel, iron, alloys thereof, or combinations thereof). During the HPHT process, the metal-solvent catalyst may liquefy and infiltrate the diamond material 410 to form the PCD table 428 and integrally bond (e.g., a metallurgical bond) the PCD table 428 to the substrate 402. However, it is noted that the catalyst may be provided from a source other than or besides the substrate 402 (e.g., from a metal film disposed between the substrate 402 and diamond material 410, catalyst mixed with the mass of diamond particles, another suitable location, or combinations thereof) and/or the PCD table 428 may be bonded to the substrate 402 using another suitable method (e.g., brazing).

After the HPHT process, the enclosure may be removed from the PDC 426. The enclosure may be removed from the PDC 426 using any suitable technique. For example, the enclosure may be removed via grit blasting and/or grinding.

In an embodiment, the PCD table 428 may be leached to deplete a metal-solvent catalyst or a metallic infiltrant therefrom to enhance the thermal stability of the PCD table 428. For example, the PCD table 428 may be leached to remove at least a portion of the metal-solvent catalyst from a working region thereof to a selected depth that was used to initially sinter the diamond grains to form a leached thermally-stable region. The leached thermally-stable region may extend inwardly from a working surface of the PCD table 428 to a selected depth. In an embodiment, the depth of the thermally-stable region may be about 10 μm to about 1500 μm. In an embodiment, the selected depth is about 50 μm to about 100 μm, about 200 μm to about 450 μm, about 450 μm to about 600 μm, about 400 μm to about 800 μm, about 800 μm to about 1500 μm, or greater than 1500 μm. The leaching may be performed in a suitable acid, such as aqua regia, nitric acid, hydrofluoric acid, or mixtures of the foregoing.

In an embodiment, after forming the PCD table 428, at least a portion of the PDC 426 may be subjected to post-HPHT shaping processes (e.g., machined) to at least one of change a shape or dimension of the PDC (e.g., change an outside diameter of the PDC 426), remove undesired geometry flaws from the PDC 426 (e.g., flatten a concave top surface 430 of the PCD table 428 formed via warping), shape the PCD table 438 (e.g., form a chamfer in the PCD table 428), or polish the PCD table 438. The PDC 426 may be machined using any suitable technique. For example, the PDC 426 may be machined by laser ablation techniques, centerless grinding, lapping, electro-discharge machining, or any other suitable machining technique. The PDC 426 may be machined either before and/or after leaching the PCD table 428. As previously discussed, the concave bottom surface of the substrate (e.g., bottom surface 206 shown in FIG. 2A) may allow the substrate 402 to exhibit a flat or concave bottom surface after the HPHT process. The flat or concave bottom surface of the substrate provides a good datum for the post-HPHT shaping processes.

The disclosed PCD and PDC embodiments may be used in many applications including, but not limited to, use in a rotary drill bit (FIGS. 5A and 5B), a thrust-bearing apparatus (FIG. 6), a radial bearing apparatus (FIG. 7), a subterranean drilling system (FIG. 8), and/or a wire-drawing die. The various applications discussed above are merely some examples of applications in which the PCD and PDC embodiments may be used. Other applications are contemplated, such as employing the disclosed PCD and PDC embodiments in friction stir welding tools.

Figure 5A:
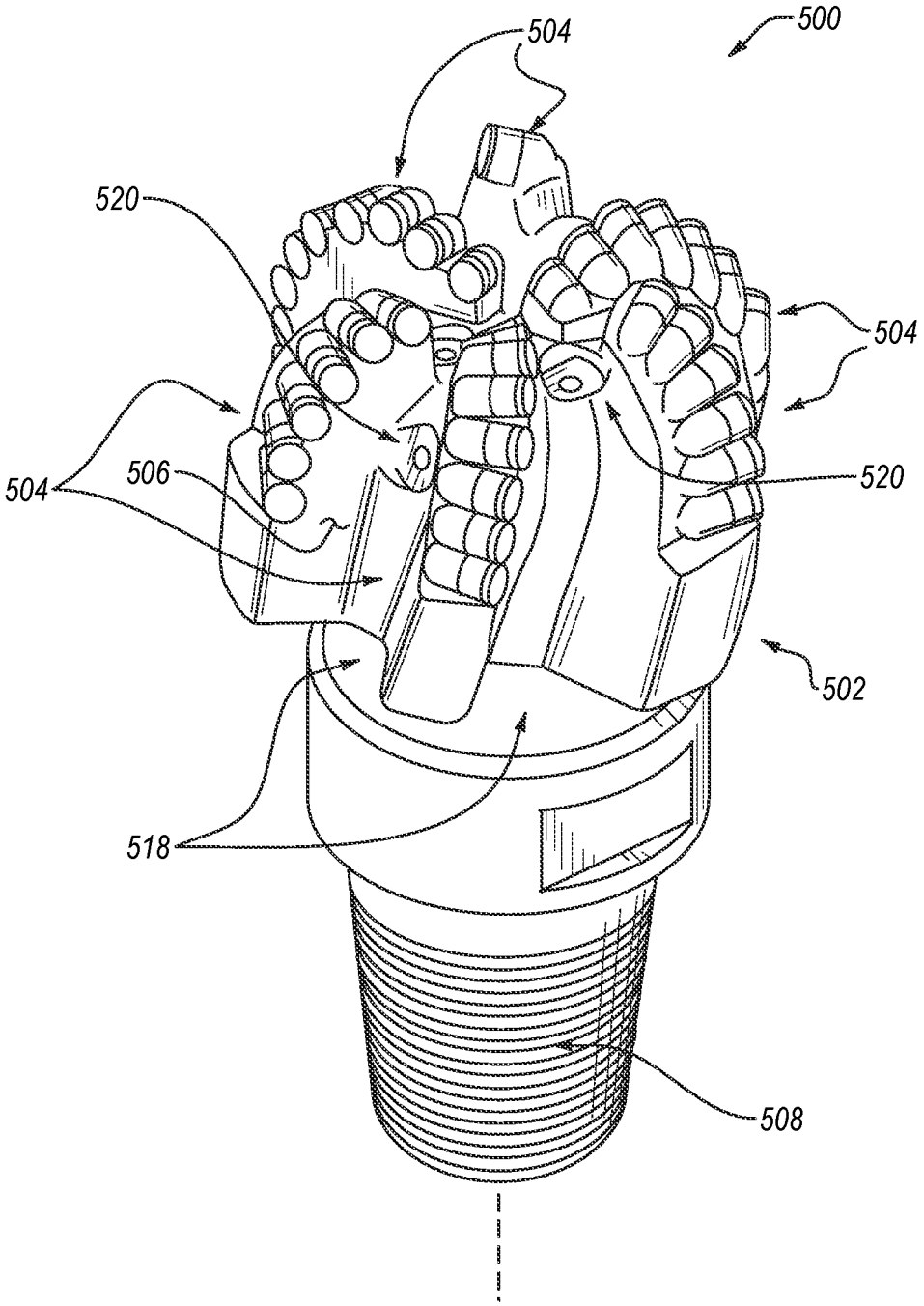
FIG. 5A is an isometric view and FIG. 5B is a top elevation view of an embodiment of a rotary drill bit, according to an embodiment.
Figure 5B:
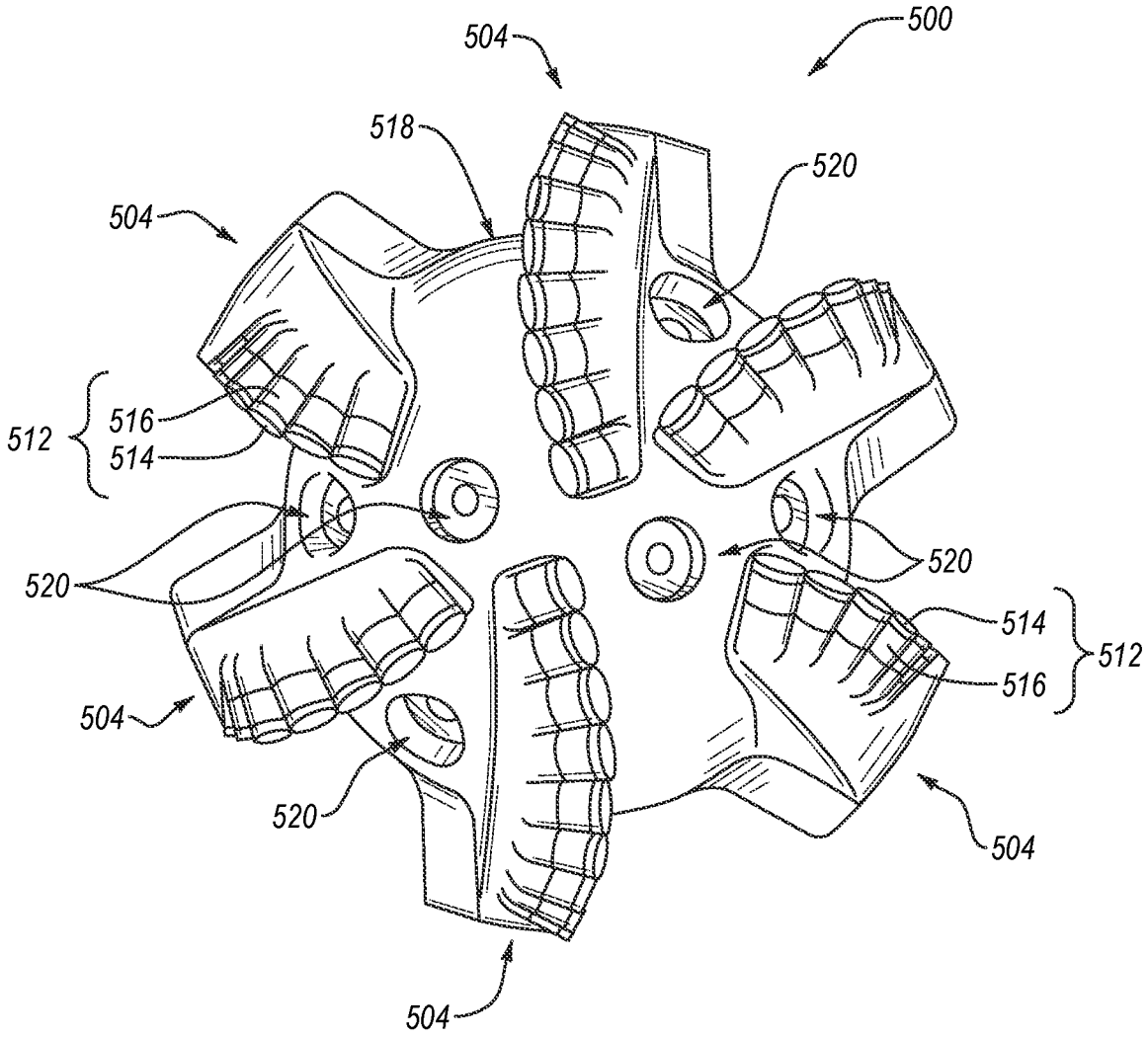

FIG. 5A is an isometric view and FIG. 5B is a top elevation view of an embodiment of a rotary drill bit 500, according to an embodiment. The rotary drill bit 500 includes at least one PDC with a shaped substrate configured according to any of the previously described embodiments. The rotary drill bit 500 comprises a bit body 502 that includes radially and longitudinally extending blades 504 with leading faces 506, and a threaded pin connection 508 for connecting the bit body 502 to a drilling string. The bit body 502 defines a leading end structure for drilling into a subterranean formation by rotation about a longitudinal axis 510 and application of weight-on-bit. At least one PDC cutting element, configured according to any of the previously described PDC embodiments (e.g., the PDC 426 shown in FIG. 4), may be affixed to the bit body 502. With reference to FIG. 5B, a plurality of PDCs 512 are secured to the blades 504. For example, each PDC 512 may include a PCD table 514 bonded to a substrate 516. More generally, one or more of the PDCs 512 may comprise any PDC element(s) disclosed herein, without limitation. In addition, if desired, in some embodiments, a number of the PDCs 512 may be conventional in construction. Also, circumferentially adjacent blades 504 define so-called junk slots 518 therebetween, as known in the art. Additionally, the rotary drill bit 500 may include a plurality of nozzle cavities 520 for communicating drilling fluid from the interior of the rotary drill bit 500 to the PDCs 512.

FIGS. 5A and 5B merely depict an embodiment of a rotary drill bit 500 that employs at least one cutting element comprising a PDC fabricated and/or structured in accordance with any embodiment disclosed herein, without limitation. The rotary drill bit 500 may represent any number of earth-boring tools or drilling tools, including, for example, core bits, roller-cone bits, fixed-cutter bits, eccentric bits, bicenter bits, reamers, reamer wings, or any other downhole tool including PDCs, without limitation.

Figure 6:
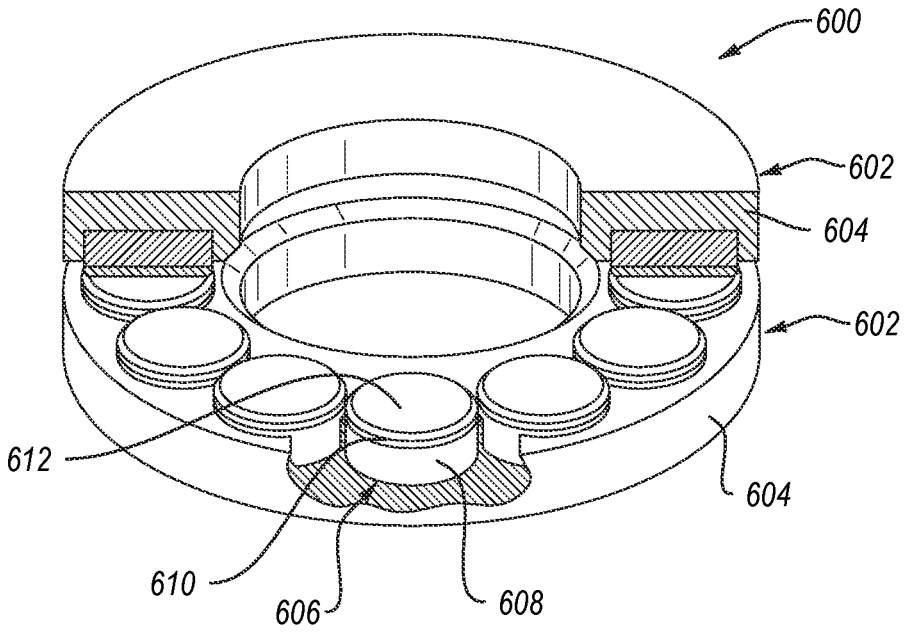
FIG. 6 is an isometric cut-away view of an embodiment of a thrust-bearing apparatus, which may utilize any of the disclosed embodiments, according to an embodiment.

FIG. 6 is an isometric cut-away view of an embodiment of a thrust-bearing apparatus 600, which may utilize any of the disclosed embodiments (e.g., included in a PCD bearing element), according to an embodiment. The thrust-bearing apparatus 600 includes respective thrust-bearing assemblies 602. Each thrust-bearing assembly 602 includes a support ring 604 that may be fabricated from a material, such as carbon steel, stainless steel, or another suitable material. Each support ring 604 includes a plurality of recesses (not labeled) that receives a corresponding bearing element 606. Each bearing element 606 may be mounted to a corresponding support ring 604 within a corresponding recess by brazing, press-fitting, using fasteners, or another suitable mounting technique. One or more, or all of bearing elements 606 may be configured according to any of the disclosed embodiments. For example, each bearing element 606 may include a shaped substrate 608 and a PCD table 610, with the PCD table 610 including a bearing surface 612.

In use, the bearing surfaces 612 of one of the thrust-bearing assemblies 602 bears against the opposing bearing surfaces 612 of the other one of the bearing assemblies 602. For example, one of the thrust-bearing assemblies 602 may be operably coupled to a shaft to rotate therewith and may be termed a "rotor." In such an example, the other one of the thrust-bearing assemblies 602 may be held stationary and may be termed a "stator."

Figure 7:
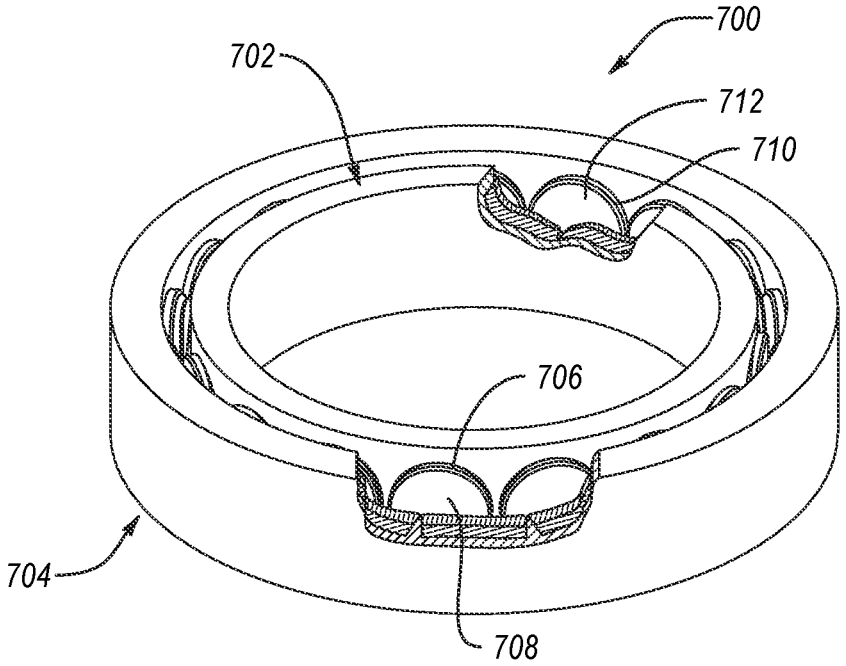
FIG. 7 is an isometric cut-away view of an embodiment of a radial bearing apparatus, which may utilize any of the disclosed embodiments, according to an embodiment.

FIG. 7 is an isometric cut-away view of an embodiment of a radial bearing apparatus 700, which may utilize any of the disclosed embodiments, according to an embodiment. The radial bearing apparatus 700 includes an inner race 702 positioned generally within an outer race 704. The outer race 704 includes a plurality of bearing elements 706 affixed thereto that have respective bearing surfaces 708. The inner race 702 also includes a plurality of bearing elements 710 affixed thereto that have respective bearing surfaces 712. One or more, or all of the bearing elements 706 and 710 may be configured according to any of the PDC embodiments disclosed herein. The inner race 702 is positioned generally within the outer race 704 and, thus, the inner race 702 and outer race 704 may be configured so that the bearing surfaces 708 and 712 may at least partially contact one another and move relative to each other as the inner race 702 and outer race 704 rotate relative to each other during use.

The radial-bearing apparatus 700 may be employed in a variety of mechanical applications. For example, so-called "roller cone" rotary drill bits may benefit from a radial-bearing apparatus disclosed herein. More specifically, the inner race 702 may be mounted to a spindle of a roller cone and the outer race 704 may be mounted to an inner bore formed within a cone and that such an outer race 704 and inner race 702 may be assembled to form a radial-bearing apparatus.

Figure 8:
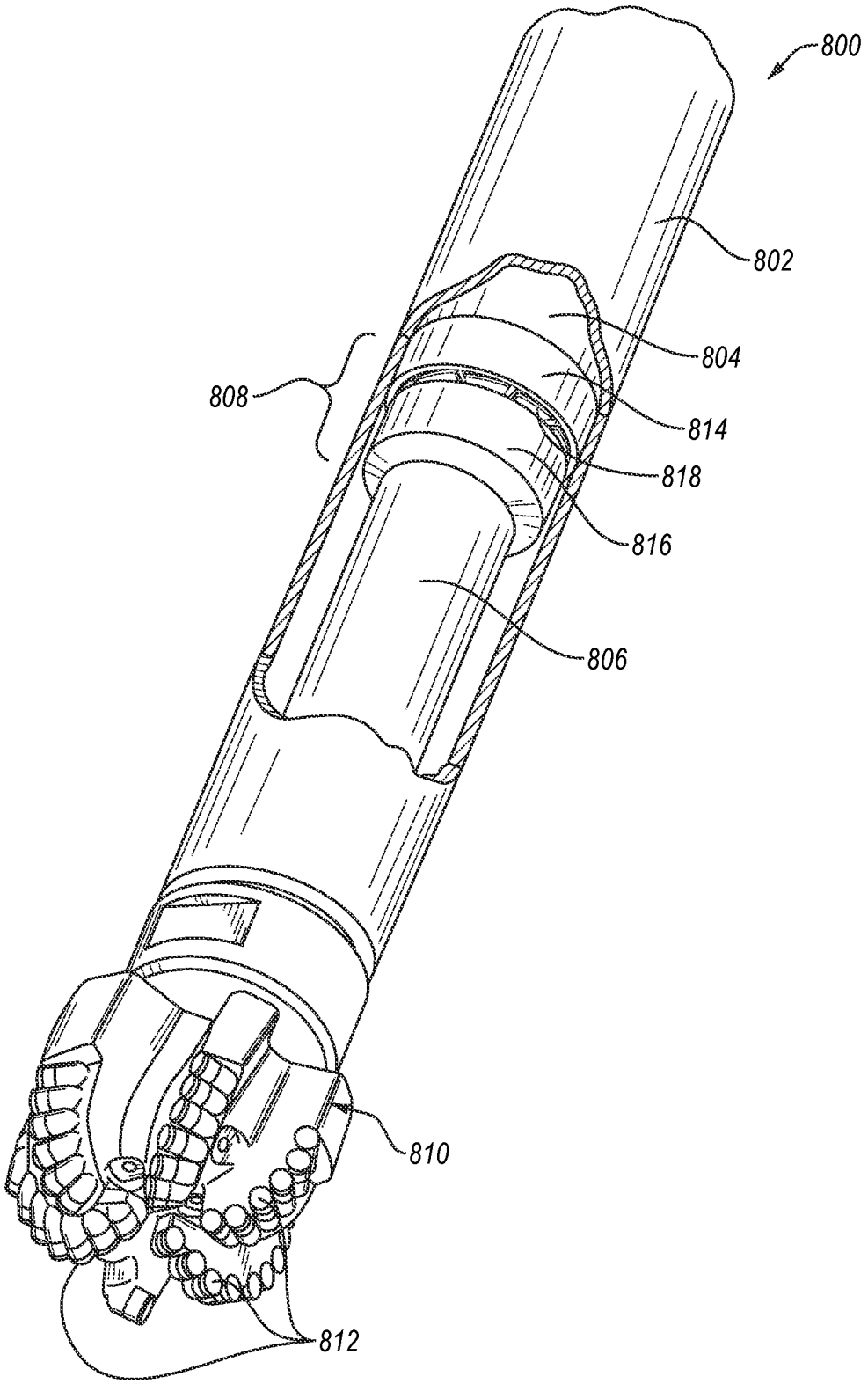
FIG. 8 is a schematic isometric cutaway view of an embodiment of a subterranean drilling system that uses a thrust-bearing apparatus, according to an embodiment.

Any of the embodiments for bearing apparatuses and/or cutting elements (e.g., superhard compacts) discussed above may be used in a subterranean drilling system. FIG. 8 is a schematic isometric cutaway view of an embodiment of a subterranean drilling system 800 that uses a thrust-bearing apparatus, according to an embodiment. The subterranean drilling system 800 includes a housing 802 enclosing a downhole drilling motor 804 (i.e., a motor, turbine, or any other device capable of rotating an output shaft) that is operably connected to an output shaft 806. A thrust-bearing apparatus 808 is operably coupled to the downhole drilling motor 804. The thrust-bearing apparatus 808 may be configured as any of the previously described thrust-bearing apparatus embodiments. A rotary drill bit 810 configured to engage a subterranean formation and drill a borehole is connected to the output shaft 806. The rotary drill bit 810 is shown as so-called "fixed cutter" drill bit including a plurality of blades having a plurality of PDC cutting elements 812 mounted thereon. However, in other embodiments, the rotary drill bit 810 may be configured as a roller cone bit including a plurality of roller cones.

In an embodiment, the thrust-bearing apparatus 808 may include a stator 814 that does not rotate and a rotor 816 that is attached to the output shaft 806 and rotates with the output shaft 806. In such an embodiment, the stator 814 may include a plurality of circumferentially spaced tilting pads 818 or other suitable bearing elements (not shown). The stator 814 may include any of the features illustrated, described, or disclosed herein.

In operation, drilling fluid may be circulated through the downhole drilling motor 804 to generate torque and effect rotation of the output shaft 806 and the rotary drill bit 810 attached thereto so that a borehole may be drilled. A portion of the drilling fluid is also used to lubricate opposing bearing surfaces of the stator 814 and rotor 816. As the borehole is drilled, pipe sections may be connected to the subterranean drilling system 800 to form a drill string capable of progressively drilling the borehole to a greater depth within the earth.

While various aspects and embodiments have been disclosed herein, other aspects and embodiments are contemplated. The various aspects and embodiments disclosed herein are for purposes of illustration and are not intended to be limiting.

While various aspects and embodiments have been disclosed herein, other aspects and embodiments are contemplated. The various aspects and embodiments disclosed herein are for purposes of illustration and are not intended to be limiting. Additionally, the words "including," "having," and variants thereof (e.g., "includes" and "has") as used herein, including the claims, shall have the same meaning as the word "comprising" and variants thereof (e.g., "comprise" and "comprises").

Terms of degree (e.g., "about," "substantially," "generally," etc.) indicate structurally or functionally insignificant variations. In an example, when the term of degree is included with a term indicating quantity, the term of degree is interpreted to mean±10%, ±5%, or +2% of the term indicating quantity. In an example, when the term of degree is used to modify a shape, the term of degree indicates that the shape being modified by the term of degree has the appearance of the disclosed shape. For instance, the term of degree may be used to indicate that the shape may have rounded corners instead of sharp corners, curved edges instead of straight edges, one or more protrusions extending therefrom, is oblong, is the same as the disclosed shape, etc.

What is claimed is:

1. An assembly, comprising:

a substrate including an interfacial surface, a bottom surface opposite the interfacial surface, and at least one lateral surface extending at least partially between the interfacial surface and the bottom surface;

a diamond material positioned at least proximate to the interfacial surface of the substrate;

an enclosure including an enclosure body, the enclosure defining a chamber and an opening, wherein the substrate and the diamond material are disposed in the chamber; and a sealant positioned at least proximate to the opening of the enclosure body, the sealant comprising a binary alloy including at least one of iron, cobalt, or nickel and a group 11 element, the enclosure includes an enclosure cap covering the opening, and wherein the sealant is configured to define a seal with the sealant contacting and extending from the bottom surface of the substrate to the enclosure cap.

2. The assembly of claim 1, wherein the diamond material includes a mass of diamond particles or a preformed polycrystalline diamond table.

3. The assembly of claim 1, wherein the diamond material includes a mass of diamond particles and the mass of diamond particles exhibit an average grain size of about 30 or less.

4. The assembly of claim 1, wherein the group 11 element of the sealant includes copper, silver, or gold.

5. The assembly of claim 1, wherein the sealant includes cobalt and the enclosure includes niobium or tantalum.

6. The assembly of claim 1, wherein the sealant includes a copper-nickel alloy.

7. The assembly of claim 6, wherein the copper-nickel alloy includes about 40 weight % to about 90 weight % of copper.

8. The assembly of claim 1, wherein the bottom surface of the substrate is concave.

9. An assembly, comprising:

a substrate including an interfacial surface, a concave bottom surface positioned opposite the interfacial surface at a rearmost portion of the substrate, and at least one lateral surface extending at least partially between the interfacial surface and the bottom surface; and a diamond material positioned adjacent to the interfacial surface of the substrate and opposing the concave bottom surface, the diamond material including diamond particles.

10. The assembly of claim 9, wherein the substrate exhibits a maximum width measured between the at least one lateral surface is at least 1.5 times greater than a maximum length of the substrate measured from the interfacial surface to the bottom surface.

11. The assembly of claim 10, wherein the maximum width of the substrate is at least 2 times greater than the maximum length of the substrate.

12. The assembly of claim 10, wherein the maximum width of the substrate is at least 4 times greater than the maximum length of the substrate.

13. The assembly of claim 9 wherein the substrate exhibits a first length and a second length measured from the interfacial surface to the bottom surface and parallel to each other, the first length measured closer to the at least one lateral surface of the substrate than the second length, wherein the first length is greater than the second length by about 100 μm or more.

14. The assembly of claim 13, wherein the first length is greater than the second length by about 225 μm or more.

15. The assembly of claim 9, further comprising an enclosure defining a chamber and an opening, wherein the substrate and the diamond material are disposed in the chamber.

16. The assembly of claim 15, further comprising a sealant positioned at least proximate to the opening of the enclosure, the sealant configured to form a binary alloy including a group 8 element or an iron group element and a group 11 element after being subjected to a heating process.

17. A method, comprising:

disposing the substrate and the diamond material in the chamber defined by the enclosure of claim 1;

applying an inert environment to at least the chamber;

heating the assembly to a degassing temperature effective to at least partially remove absorbed gases from the diamond material; and melting the sealant such that the sealant seals the chamber.

18. An assembly, comprising:

a substrate including an interfacial surface, a rear surface opposite the interfacial surface, and at least one lateral surface extending at least partially between the interfacial surface and the rear surface;

a diamond material positioned at the interfacial surface of the substrate;

an enclosure defining a chamber and an opening, wherein the substrate and the diamond material are disposed in the chamber; and a sealant positioned at least partially within the opening of the enclosure proximate the rear surface of the substrate and spaced from the diamond material, the sealant configured to define a binary alloy including a group 8 element or an iron group element and a group 11 element after being subjected to a heating process, the sealant further configured to extend to and contact the substrate after being subjected to the heating process.

19. The assembly of claim 18, wherein the enclosure includes an enclosure body and an enclosure cap covering the opening, and wherein the sealant is position between at least a portion of the enclosure body and the enclosure cap.

20. The assembly of claim 18, wherein the iron group element comprises at least one of iron, cobalt, or nickel.

21. The assembly of claim 20, wherein the group 11 element of the sealant comprises at least one of copper, silver, or gold.

22. The assembly of claim 18, wherein the group 11 element of the sealant comprises at least one of copper, silver, or gold.

23. The assembly of claim 18, wherein the rear surface of the substrate comprises a concave surface extending radially along a proximal portion of the substrate.

24. An assembly, comprising:

a substrate including an interfacial surface, a rear surface opposite the interfacial surface, and at least one lateral surface extending at least partially between the interfacial surface and the rear surface, the rear surface of the substrate exhibiting a concave shape extending radially along a proximal portion of the substrate; and a diamond material positioned adjacent to the interfacial surface of the substrate and opposing the rear surface, the diamond material including diamond particles.

25. The assembly of claim 24, wherein a radially inner portion of the concave shape of the rear surface of the substrate is positioned relatively closer to the diamond material than a radially outer portion of the concave shape of the rear surface of the substrate.

* * * * *